US010838315B2

(12) United States Patent
Shimozawa et al.

(10) Patent No.: US 10,838,315 B2
(45) Date of Patent: Nov. 17, 2020

(54) ELECTROPHOTOGRAPHIC PHOTOSENSITIVE MEMBER, PROCESS CARTRIDGE AND ELECTROPHOTOGRAPHIC APPARATUS

(71) Applicant: CANON KABUSHIKI KAISHA, Tokyo (JP)

(72) Inventors: Hideharu Shimozawa, Numazu (JP); Tsutomu Nishida, Mishima (JP); Atsushi Okuda, Yokohama (JP); Yuka Ishiduka, Suntou-gun (JP); Nobuhiro Nakamura, Numazu (JP); Hiroyuki Watanabe, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/272,268

(22) Filed: Feb. 11, 2019

(65) Prior Publication Data

US 2019/0265603 A1 Aug. 29, 2019

(30) Foreign Application Priority Data

Feb. 28, 2018 (JP) ..... 2018-035742

(51) Int. Cl.
*G03G 5/147* (2006.01)
*G03G 5/05* (2006.01)
*G03G 5/07* (2006.01)

(52) U.S. Cl.
CPC ..... *G03G 5/14791* (2013.01); *G03G 5/0525* (2013.01); *G03G 5/0546* (2013.01); *G03G 5/075* (2013.01); *G03G 5/14721* (2013.01); *G03G 5/14734* (2013.01); *G03G 5/14795* (2013.01)

(58) Field of Classification Search
CPC ..... G03G 5/14791; G03G 5/14721; G03G 5/0546; G03G 5/0525; G03G 5/14734; G03G 5/075
See application file for complete search history.

(56) References Cited

U.S. PATENT DOCUMENTS 5,374,494 A * 12/1994 Kashimura ..... G03G 5/0592 358/296
6,991,881 B2 1/2006 Ogaki et al.
6,994,941 B2 2/2006 Tanaka et al.
7,001,699 B2 2/2006 Tanaka et al.
7,645,547 B2 1/2010 Okuda et al.
7,655,370 B2 2/2010 Kitamura et al.
7,910,274 B2 3/2011 Tanaka et al.
8,088,541 B2 1/2012 Tanaka et al.
8,455,170 B2 6/2013 Nakamura et al.
8,481,236 B2 7/2013 Tanaka et al.
8,632,935 B2 1/2014 Sugiyama et al.
8,669,027 B2 3/2014 Anezaki et al.
8,753,789 B2 6/2014 Ogaki et al.
8,765,335 B2 7/2014 Tanaka et al.
8,815,479 B2 8/2014 Shida et al.
8,846,281 B2 9/2014 Okuda et al.
(Continued)

FOREIGN PATENT DOCUMENTS

JP 04260052 A * 9/1992
JP 2012-032500 2/2012

OTHER PUBLICATIONS

U.S. Appl. No. 16/286,762, Nobuhiro Nakamura, filed Feb. 27, 2019.
U.S. Appl. No. 16/287,102, Tsutomu Nishida, filed Feb. 27, 2019.

*Primary Examiner* — Christopher D Rodee
(74) *Attorney, Agent, or Firm* — Venable LLP

(57) ABSTRACT

An electrophotographic photosensitive member having a protective layer wherein the density unevenness among output images is reduced with abrasion resistance maintained is provided. The present invention is an electrophotographic photosensitive member having a support, a photosensitive layer and a protective layer in this order, wherein the protective layer has a triarylamine structure and a cyclic structure represented by the formula (1) or (2):

(1)

(2)

and an A value expressed by expression (4), A=S1/S2, wherein, in expression (4), S1 is a peak area based on in-plane deformation vibration of terminal olefin ($CH_2$=), and S2 is a peak area based on stretching vibration of C=O among peak areas of a spectrum obtained by measuring a surface of the protective layer by total reflection Fourier transform infrared spectroscopy using Ge as an internal reflection element and using a measurement condition of 45° as an incidence angle is from 0.065 to 0.100.

7 Claims, 1 Drawing Sheet

(56) References Cited

U.S. PATENT DOCUMENTS

| | | | |
|---|---|---|---|
| 8,865,381 | B2 | 10/2014 | Tanaka et al. |
| 8,921,020 | B2 | 12/2014 | Murai et al. |
| 8,980,508 | B2 | 3/2015 | Okuda et al. |
| 8,980,509 | B2 | 3/2015 | Noguchi et al. |
| 9,029,054 | B2 | 5/2015 | Okuda et al. |
| 9,040,214 | B2 | 5/2015 | Fujii et al. |
| 9,046,797 | B2 | 6/2015 | Fujii et al. |
| 9,063,505 | B2 | 6/2015 | Sekiya et al. |
| 9,069,267 | B2 | 6/2015 | Kaku et al. |
| 9,114,565 | B2 | 8/2015 | Kawai et al. |
| 9,170,506 | B2 | 10/2015 | Tanaka et al. |
| 9,170,507 | B2 | 10/2015 | Sugiyama et al. |
| 9,188,888 | B2 | 11/2015 | Okuda et al. |
| 9,207,550 | B2 | 12/2015 | Okuda et al. |
| 9,256,145 | B2 | 2/2016 | Fujii et al. |
| 9,280,071 | B2 | 3/2016 | Maruyama et al. |
| 9,280,072 | B2 | 3/2016 | Ogaki et al. |
| 9,282,615 | B2 | 3/2016 | Yamagishi et al. |
| 9,304,416 | B2 | 4/2016 | Noguchi et al. |
| 9,341,964 | B2 | 5/2016 | Ogaki et al. |
| 9,372,417 | B2 | 6/2016 | Fujii et al. |
| 9,372,418 | B2 | 6/2016 | Shida et al. |
| 9,372,419 | B2 | 6/2016 | Tsuji et al. |
| 9,436,106 | B2 | 9/2016 | Kuno et al. |
| 9,436,107 | B2 | 9/2016 | Murakami et al. |
| 9,459,545 | B2 | 10/2016 | Tanaka et al. |
| 9,523,929 | B2 | 12/2016 | Nakamura et al. |
| 9,535,346 | B2 | 1/2017 | Sekiya et al. |
| 9,541,850 | B2 | 1/2017 | Nishida et al. |
| 9,563,139 | B2 | 2/2017 | Kawahara et al. |
| 9,575,422 | B2 | 2/2017 | Okuda et al. |
| 9,599,915 | B2 | 3/2017 | Anezaki et al. |
| 9,599,917 | B2 | 3/2017 | Okuda et al. |
| 9,645,515 | B2 | 5/2017 | Kuno et al. |
| 9,645,516 | B2 | 5/2017 | Kawahara et al. |
| 9,684,277 | B2 | 6/2017 | Yamamoto et al. |
| 9,726,992 | B2 | 8/2017 | Sakuma et al. |
| 9,772,596 | B2 | 9/2017 | Mitsui et al. |
| 9,791,792 | B2 | 10/2017 | Miyauchi et al. |
| 9,869,032 | B2 | 1/2018 | Kawahara et al. |
| 10,073,362 | B2 | 9/2018 | Fujii et al. |
| 2012/0028179 | A1 | 2/2012 | Li et al. |
| 2014/0004450 | A1 | 1/2014 | Tokimitsu et al. |
| 2014/0093281 | A1 | 4/2014 | Takahashi et al. |
| 2014/0186758 | A1 | 7/2014 | Bellino et al. |
| 2015/0168908 | A1* | 6/2015 | Black ..... G03G 5/0575 430/56 |
| 2015/0185630 | A1 | 7/2015 | Ito et al. |
| 2015/0185634 | A1 | 7/2015 | Sekiya et al. |
| 2015/0185642 | A1 | 7/2015 | Bellino et al. |
| 2015/0277246 | A1 | 10/2015 | Kaku et al. |
| 2015/0277247 | A1 | 10/2015 | Sekiya et al. |
| 2015/0316863 | A1 | 11/2015 | Tanaka et al. |
| 2015/0346616 | A1 | 12/2015 | Kawahara et al. |
| 2015/0346617 | A1 | 12/2015 | Kawahara et al. |
| 2015/0362847 | A1 | 12/2015 | Tanaka et al. |
| 2016/0091807 | A1 | 3/2016 | Tanaka et al. |
| 2016/0131985 | A1 | 5/2016 | Tanaka et al. |
| 2017/0060008 | A1 | 3/2017 | Okuda et al. |
| 2017/0192368 | A1* | 7/2017 | Black ..... G03G 5/0525 |
| 2018/0059558 | A1 | 3/2018 | Ito et al. |
| 2018/0341190 | A1 | 11/2018 | Nishi et al. |

* cited by examiner

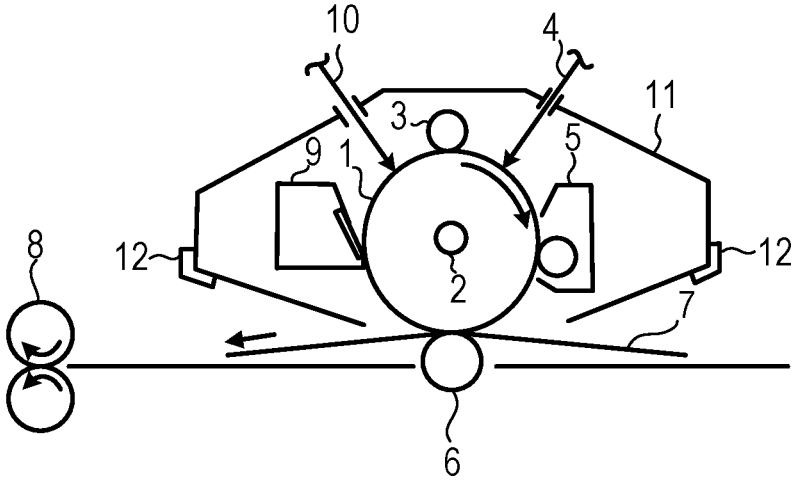
10
4
11
3
9
1
5
8
12
2
12
7
6

ELECTROPHOTOGRAPHIC PHOTOSENSITIVE MEMBER, PROCESS CARTRIDGE AND ELECTROPHOTOGRAPHIC APPARATUS

BACKGROUND OF THE INVENTION

Field of the Invention

The present invention relates to an electrophotographic photosensitive member, a process cartridge and an electrophotographic apparatus having the electrophotographic photosensitive member.

Description of the Related Art

An electrophotographic photosensitive member with which an electrophotographic apparatus is equipped has been widely examined so far to improve image quality and durability. An example thereof is the examination of improving abrasion resistance (mechanical durability) using a radically polymerizable resin on the surface of an electrophotographic photosensitive member. Meanwhile, density unevenness among output images might deteriorate as harmful influence due to improvement in abrasion resistance. It is considered that this is due to decrease in the number of carbon-carbon double bond groups on the surface of the electrophotographic photosensitive member with the advance of radical polymerization and decrease in charge transportability on the surface of the electrophotographic photosensitive member.

In U.S. Patent Application Publication No. 2014/186758, the technique of improving abrasion resistance by introducing urethane groups into surface resin is described. In Japanese Patent Application Laid-Open No. 2012-32500, the technique of reducing density unevenness among output images and density unevenness in the plane of an output image by adding a specific silole compound into a protective layer is described. In U.S. Patent Application Publication No. 2015/185642, the technique of improving image quality in the initial stage of picture output by reducing the degree of acrylic polymerization in a protective layer is described.

SUMMARY OF THE INVENTION

According to the examination of the present inventors, it has been found that the density unevenness among output images may be suppressed insufficiently in composition disclosed in U.S. Patent Application No. 2014/186758, and the abrasion resistance may be insufficient in composition disclosed in Japanese Patent Application Laid-Open No. 2012-32500. It has been found that the image quality may deteriorate in continuous image output in composition disclosed in U.S. Patent Application Publication No. 2015/185642.

Therefore, an object of the present invention is to provide an electrophotographic photosensitive member wherein the density unevenness among output images is reduced with abrasion resistance maintained in the electrophotographic photosensitive member having a protective layer.

The above-mentioned object is achieved by the following present invention. That is, an electrophotographic photosensitive member according to the present invention is an electrophotographic photosensitive member, having a support, a photosensitive layer and a protective layer in this order, wherein the protective layer has a triarylamine structure and a cyclic structure represented by the following general formula (1) or (2):

(1)

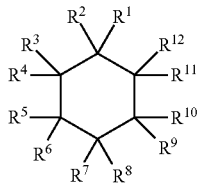

wherein, in general formula (1), at least two of $R^1$, $R^5$ and $R^9$ are each a structure represented by the following general formula (3), and the remaining substituents are each a hydrogen atom or a methyl group in $R^1$ to $R^{12}$, (2)

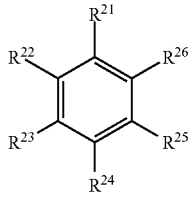

wherein, in general formula (2), at least two of $R^{21}$, $R^{23}$ and $R^{25}$ are each a structure represented by the following general formula (3), and the remaining substituents are each a hydrogen atom or a methyl group in $R^{21}$ to $R^{26}$, (3)

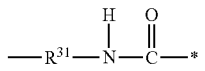

wherein, in general formula (3), $R^{31}$ is a single bond or a methylene group optionally having a substituent, and * represents having a bond; and an A value expressed by the following expression (4) is 0.065 or more and 0.100 or less, $$A = S1/S2 \quad (4)$$

wherein, in the above-mentioned expression (4), S1 is a peak area based on in-plane deformation vibration of terminal olefin ($CH_2$=), and S2 is a peak area based on stretching vibration of C=O among peak areas of a spectrum obtained by measuring a surface of the protective layer by total reflection Fourier transform infrared spectroscopy using Ge as an internal reflection element and using a measurement condition of 45° as an incidence angle.

According to the present invention, an electrophotographic photosensitive member wherein the density unevenness among output images is reduced with abrasion resistance maintained in the electrophotographic photosensitive member having the protective layer can be provided.

Further features of the present invention will become apparent from the following description of exemplary embodiments with reference to the attached drawing.

BRIEF DESCRIPTION OF THE DRAWINGS

FIGURE is a schematic diagram illustrating an image-forming apparatus and a process cartridge of the present invention.

DESCRIPTION OF THE EMBODIMENTS

Preferred embodiments of the present invention will now be described in detail in accordance with the accompanying drawing.

It is known that when the curing of the protective layer on the surface of a photosensitive member is promoted to improve the abrasion resistance of the photosensitive member, the density unevenness among output images deteriorates easily due to a decrease in charge transportability. It is considered that this is due to decrease in the number of carbon-carbon double bond groups on the surface of the electrophotographic photosensitive member with the advance of radical polymerization and decrease in charge transportability on the surface of the electrophotographic photosensitive member.

To improve density unevenness among output images, it is effective to suppress curing and improve the charge transportability of the protective layer. As a result of the examination of the present inventors, it has been found that the protective layer exhibits satisfactory charge transportability by controlling the ratio A of the peak area S1 based on the in-plane deformation vibration of terminal olefin ($CH_2$=) to the peak area S2 based on the stretching vibration of C=O which are obtained by measuring the surface of the protective layer using total reflection infrared spectroscopy (=S1/S2) in the range of 0.065 or more and 0.100 or less.

Meanwhile, a problem is that when curing is suppressed, and the above-mentioned A value is controlled in the range of 0.065 or more and 0.100 or less, the abrasion resistance deteriorates. The present inventors have found that the protective layer on the surface of a photosensitive member has a triarylamine structure and a cyclic structure represented by the following general formula (1) or (2), the abrasion resistance is improved thereby, and the abrasion resistance and improvement in the density unevenness of output images are compatible. It is presumed that this is because the following general formula (1) or (2) has both a cyclic structure which exhibits abrasion resistance and a urethane structure.

(1)

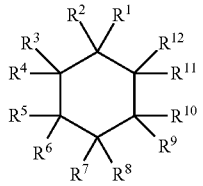

wherein, in general formula (1), at least two of $R^1$, $R^5$ and $R^9$ are each a structure represented by the following general formula (3), and the remaining substituents are each a hydrogen atom or a methyl group in $R^1$ to $R^{12}$.

(2)

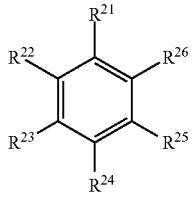

wherein, in general formula (2), at least two of $R^{21}$, $R^{23}$ and $R^{25}$ are each a structure represented by the following general formula (3), and the remaining substituents are each a hydrogen atom or a methyl group in $R^{21}$ to $R^{26}$.

(3)

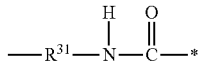

wherein, in general formula (3), $R^{31}$ is a single bond or a methylene group optionally having a substituent, and * represents having a bond.

Preferable examples of the above-mentioned general formula (1) are illustrated in structural formula (1-1) to structural formula (1-3). Among these, structural formula (1-1) is more preferable.

(1-1)

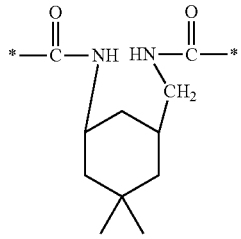

(1-2)

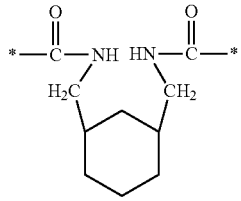

(1-3)

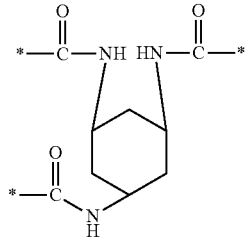

Preferable examples of the above-mentioned general formula (2) are shown in structural formula (2-1) to structural formula (2-5).

(2-1)

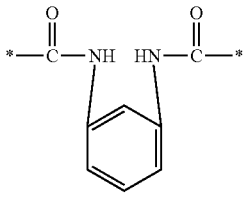

(2-2)

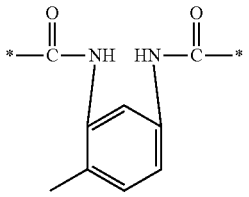

(2-3)

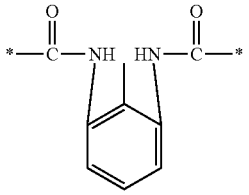

(2-4)

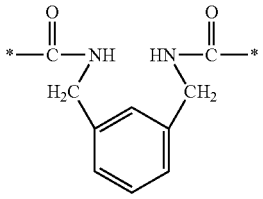

(2-5)

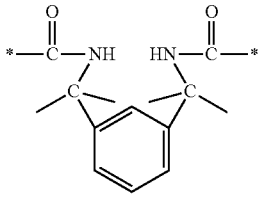

The elastic deformation rate of the protective layer is preferably 40% or more and 50% or less from the viewpoint of abrasion resistance. The elastic deformation rate was measured using a Fischer hardness tester (trade name: H100VP-HCU, manufactured by FISCHER INSTRUMENTS K.K.) in the environment of a temperature of 23° C. and a humidity of 50% RH. A Vickers pyramid diamond indenter having an angle between the opposite faces of 136° is thrust into the protective layer surface of a measuring object using the diamond indenter as an indenter. A load is applied to 2 mN over 7 seconds and then reduced gradually over 7 seconds. The indentation depth until the load is 0 mN was measured continuously. The elastic deformation rate was calculated from the result.

It is preferable that the molar ratio of the cyclic structure to the triarylamine structure be 0.2 or more and 1.4 or less. It is preferable that the protective layer have the structure represented by the following general formula (5), and the molar ratio thereof to the cyclic structure be further 1.9 or more and 2.1 or less. The abrasion resistance and the density unevenness can be maintained in a satisfactory range by incorporating this composition into the protective layer, (5)

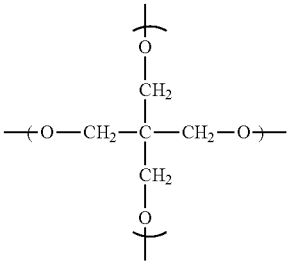

The protective layer preferably contains a triarylamine compound having no polymerizable functional group having a molecular weight of 300 or more and 1000 or less. Further, the triarylamine compound is more preferably adjusted to 1% by mass or more and 30% by mass or less based on the total mass of the protective layer. It is considered that the density of the charge transport compound in the film of the protective layer is improved, and the charge transportability can be improved by incorporating a low-molecular triarylamine compound into the film.

Preferable examples of the triarylamine compound are illustrated in structural formula (6-1) to structural formula (6-3).

(6-1)

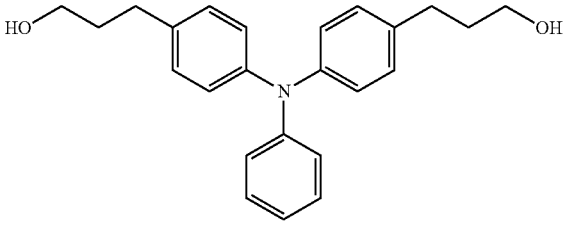

(6-2)

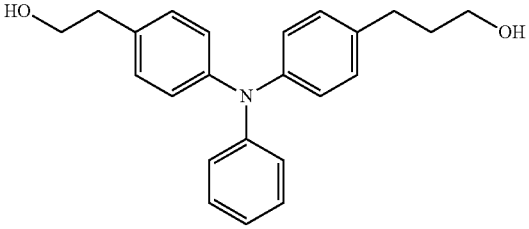

(6-3)

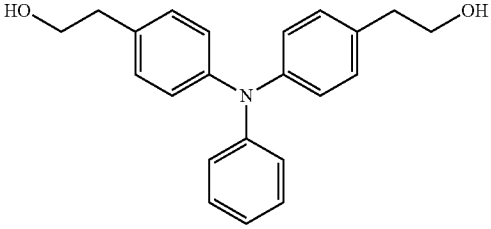

As the above-mentioned mechanism, components have effect on each other, and this enables achieving the effect of the present invention.

[Electrophotographic Photosensitive Member]

An electrophotographic photosensitive member of the present invention is characterized by having a support, a photosensitive layer and a protective layer.

Examples of a method for manufacturing the electrophotographic photosensitive member of the present invention include a method of preparing the below-mentioned coating liquids for layers, applying the coating liquids in the desired order of layers and drying the coating liquids. Examples of the method of applying coating liquids at this time include dip coating, spray coating, inkjet coating, roll coating, die coating, blade coating, curtain coating, wire bar coating and ring coating. Among these, the dip coating is preferable from the viewpoint of efficiency and productivity.

The support and the layers will be described hereafter.

<Support>

In the present invention, an electrophotographic photosensitive member has a support. In the present invention, it is preferable that the support is an electro-conductive support, which has electro-conductivity. Examples of the shape of the support include a cylindrical shape, a belt shape and a sheet shape. It is preferable that the support be especially a cylindrical support. Electrochemical treatment such as anodic oxidization; blasting processing; cutting processing or the like may be performed on the surface of the support.

As the material of the support, metal, resin, glass or the like is preferable.

Examples of the metal include aluminum, iron, nickel, copper, gold, stainless steel and alloys thereof. It is preferable that the support be especially a support made of aluminum.

Electro-conductivity may be imparted to the resin and the glass by treatment such as mixing the resin and the glass with an electro-conductive material or covering the resin and the glass with an electro-conductive material.

<Electro-Conductive Layer>

In the present invention, an electro-conductive layer may be provided on the support. The scratches and roughness on the surface of the support can be concealed and the reflection of light on the surface of the support can be controlled by providing an electro-conductive layer.

It is preferable that the electro-conductive layer contain an electro-conductive particle and a resin.

Examples of the material of electro-conductive particle include metal oxides, metals and carbon black.

Examples of the metal oxide include zinc oxide, aluminum oxide, indium oxide, silicon oxide, zirconium oxide, tin oxide, titanium oxide, magnesium oxide, antimony oxide and bismuth oxide. Examples of the metal include aluminum, nickel, iron, Nichrome, copper, zinc and silver.

It is preferable that the metal oxide be used, and it is more preferable that especially titanium oxide, tin oxide or zinc oxide be used as an electro-conductive particle among these.

When the metal oxide is used as an electro-conductive particle, the surface of the metal oxide may be treated by a silane coupling agent or the like, or the metal oxide may be doped with an element such as phosphorus or aluminum, and an oxide thereof.

The electro-conductive particle may have a layered structure having a core material particle and a covering layer covering the particle. Examples of the core material particle include titanium oxide, barium sulfate and zinc oxide. Examples of the covering layer include metal oxides such as tin oxide.

When the metal oxide is used as an electro-conductive particle, the volume average particle size is preferably 1 nm or more and 500 nm or less, and more preferably 3 nm or more and 400 nm or less.

Examples of the resin include polyester resin, polycarbonate resin, polyvinyl acetal resin, acrylic resin, silicone resin, epoxy resin, melamine resin, polyurethane resin, phenolic resin and alkyd resin.

The electro-conductive layer may further contain a masking agent such as silicone oil, a resin particle or titanium oxide.

The average film thickness of the electro-conductive layer is preferably 1 μm or more and 50 μm or less, and particularly preferably 3 μm or more and 40 μm or less.

The electro-conductive layer can be formed by preparing a coating liquid for an electro-conductive layer, wherein the coating liquid contains the above-mentioned materials and a solvent, forming a coating film thereof and drying the coating film. Examples of the solvent used for the coating liquid include alcohol-based solvents, sulfoxide-based solvents, ketone-based solvents, ether-based solvents, ester-based solvents and aromatic hydrocarbon-based solvents. Examples of the method for dispersing the electro-conductive particle in the coating liquid for the electro-conductive layer include methods using a paint shaker, a sand mill, a ball mill or a liquid collision high-speed disperser.

<Undercoating Layer>

In the present invention, an undercoating layer may be provided on the support or the electro-conductive layer. An adhesion function between layers increases, and a charge injection prevention function can be imparted by providing the undercoating layer.

It is preferable that the undercoating layer contain a resin. The undercoating layer may be formed as a cured film by polymerizing a composition containing a monomer having a polymerizable functional group.

Examples of the resin include polyester resin, polycarbonate resin, polyvinyl acetal resin, acrylic resin, epoxy resin, melamine resin, polyurethane resin, phenolic resin, polyvinyl phenolic resin, alkyd resin, polyvinyl alcohol resin, polyethylene oxide resin, polypropylene oxide resin, polyamide resin, polyamide acid resin, polyimide resin, polyamide imide resin and cellulose resin.

Examples of the polymerizable functional group which the monomer having a polymerizable functional group has include an isocyanate group, a blocked isocyanate group, a methylol group, an alkylated methylol group, an epoxy group, a metal alkoxide group, a hydroxyl group, an amino group, a carboxyl group, a thiol group, a carboxylic acid anhydride group and a carbon-carbon double bond group.

The undercoating layer may further contain an electron transport substance, a metal oxide, a metal, an electro-conductive polymer or the like to improve electrical properties. It is preferable to use the electron transport substance and the metal oxide among these.

Examples of the electron transport substance include quinone compounds, imide compounds, benzimidazole compounds, cyclopentadienylidene compounds, fluorenone compounds, xanthone compounds, benzophenone compounds, cyanovinyl compounds, aryl halide compounds, silole compounds and boron-containing compounds. The electron transport substance having a polymerizable functional group is used as an electron transport substance. The undercoating layer may be formed as a cured film by copolymerizing the electron transport substance with the monomer having the above-mentioned polymerizable functional group.

Examples of the metal oxide include indium tin oxide, tin oxide, indium oxide, titanium oxide, zinc oxide, aluminum oxide and silicon dioxide. Examples of the metal include gold, silver and aluminum.

The undercoating layer may further contain additives.

The average film thickness of the undercoating layer is preferably 0.1 μm or more and 50 μm or less, more preferably 0.2 μm or more and 40 μm or less, and particularly preferably 0.3 μm or more and 30 μm or less.

The undercoating layer can be formed by preparing a coating liquid for the undercoating layer, wherein the coating liquid contains the above-mentioned materials and a solvent, forming a coating film thereof, and drying and/or curing the coating film. Examples of the solvent used for the coating liquid include alcohol-based solvents, ketone-based solvents, ether-based solvents, ester-based solvents and aromatic hydrocarbon-based solvents.

<Photosensitive Layer>

The photosensitive layer of the electrophotographic photosensitive member is mainly classified into (1) the layered photosensitive layer and (2) the monolayer photosensitive layer. Then, (1) the layered photosensitive layer has a charge-generating layer containing a charge-generating substance and a charge transport layer containing a charge transport substance. (2) The monolayer photosensitive layer has a photosensitive layer containing both a charge-generating substance and a charge transport substance.

(1) Layered Photosensitive Layer

The layered photosensitive layer has a charge-generating layer and a charge transport layer.

Charge-Generating Layers (1-1)

It is preferable that the charge-generating layer contain a charge-generating substance and a resin.

Examples of the charge-generating substance include azo pigments, perylene pigments, polycyclic quinone pigments, an indigo pigment and phthalocyanine pigments. Among these, the azo pigments and the phthalocyanine pigments are preferable. Among the phthalocyanine pigments, an oxytitanium phthalocyanine pigment, a chlorogallium phthalocyanine pigment and a hydroxygallium phthalocyanine pigment are preferable.

The content of the charge-generating substance in the charge-generating layer is preferably 40% by mass or more and 85% by mass or less, and more preferably 60% by mass or more and 80% by mass or less based on the total mass of the charge-generating layer.

Examples of the resin include polyester resin, polycarbonate resin, polyvinyl acetal resin, polyvinyl butyral resin, acrylic resin, silicone resin, epoxy resin, melamine resin, polyurethane resin, phenolic resin, polyvinyl alcohol resin, cellulose resin, polystyrene resin, polyvinyl acetate resin and polyvinyl chloride resin. Among these, the polyvinyl butyral resin is more preferable.

The charge-generating layer may further contain additives such as an antioxidant and an ultraviolet absorber. Specific examples include hindered phenol compounds, hindered amine compounds, sulfur compounds, phosphorus compounds and benzophenone compounds.

The average film thickness of the charge-generating layer is preferably 0.1 μm or more and 1 μm or less, and more preferably 0.15 μm or more and 0.4 μm or less.

The charge-generating layer can be formed by preparing a coating liquid for the charge-generating layer, wherein the coating liquid contains the above-mentioned materials and a solvent, forming a coating film thereof and drying the coating film. Examples of the solvent used for the coating liquid include alcohol-based solvents, sulfoxide-based solvents, ketone-based solvents, ether-based solvents, ester-based solvents and aromatic hydrocarbon-based solvents.

(1-2) Charge Transport Layer

It is preferable that the charge transport layer contain a charge transport substance and a resin.

Examples of the charge transport substance include polycyclic aromatic compounds, heterocyclic compounds, hydrazone compounds, styryl compound, enamine compounds, benzidine compounds, triarylamine compounds and resins having groups derived from these substances. Among these, the triarylamine compounds and the benzidine compounds are preferable.

The content of the charge transport substance in the charge transport layer is preferably 25% by mass or more and 70% by mass or less, and more preferably 30% by mass or more and 55% by mass or less based on the total mass of the charge transport layer.

Examples of the resin include polyester resin, polycarbonate resin, acrylic resin and polystyrene resin. Among these, the polycarbonate resin and the polyester resin are preferable. As the polyester resin, especially polyarylate resin is preferable.

The content ratio (mass ratio) of the charge transport substance to the resin is preferably 4:10 to 20:10, and more preferably 5:10 to 12:10.

The charge transport layer may contain additives such as an antioxidant, an ultraviolet absorber, a plasticizer, a leveling agent, a slipperiness-imparting agent and an abrasion resistance-improving agent. Specific examples include hindered phenol compounds, hindered amine compounds, sulfur compounds, phosphorus compounds, benzophenone compounds, siloxane-modified resin, silicone oil, a fluororesin particle, a polystyrene resin particle, a polyethylene resin particle, a silica particle, an alumina particle and a boron nitride particle.

The average film thickness of the charge transport layer is preferably 5 μm or more and 50 μm or less, more preferably 8 μm or more and 40 μm or less, and particularly preferably 10 μm or more and 30 μm or less.

The charge transport layer can be formed by preparing a coating liquid for the charge transport layer, wherein the coating liquid contains the above-mentioned materials and a solvent, forming a coating film thereof and drying the coating film. Examples of the solvent used for the coating liquid include alcohol-based solvents, ketone-based solvents, ether-based solvents, ester-based solvents and aromatic hydrocarbon-based solvents. Among these solvents, the ether-based solvents and the aromatic hydrocarbon solvents are preferable.

(2) Monolayer Photosensitive Layer

The monolayer photosensitive layer can be formed by preparing a coating liquid for the photosensitive layer, wherein the coating liquid contains a charge-generating substance, a charge transport substance, a resin and a solvent, forming a coating film thereof and drying the coating film. The charge-generating substance, the charge transport substance and the resin are the same as the examples of the materials in the above-mentioned "(1) layered photosensitive layer".

<Protective Layer>

The electrophotographic photosensitive member of the present invention has a protective layer on the photosensitive layer.

As described above, the protective layer has a triarylamine structure and the cyclic structure represented by the above-mentioned general formula (1) or (2).

The protective layer may be formed as a cured film by polymerizing a composition containing a monomer having a polymerizable functional group. Examples of a reaction at that time include a thermal polymerization reaction, a photopolymerization reaction and a radiation-induced polymerization reaction. Examples of the polymerizable functional group which the monomer having the polymerizable functional group has include an acrylic group and a methacrylic group. As the monomer having the polymerizable functional group, a material having charge transport capability may be used.

The protective layer may contain additives such as an antioxidant, an ultraviolet absorber, a plasticizer, a leveling agent, a slipperiness-imparting agent and an abrasion resistance-improving agent. Specific examples include hindered phenol compounds, hindered amine compounds, sulfur compounds, phosphorus compounds, benzophenone compounds, siloxane-modified resin, silicone oil, a fluororesin particle, a polystyrene resin particle, a polyethylene resin particle, a silica particle, an alumina particle and a boron nitride particle.

The protective layer may contain an electro-conductive particle and/or a charge transport substance, and a resin.

Examples of the electro-conductive particle include particles of metal oxides such as titanium oxide, zinc oxide, tin oxide and indium oxide.

Examples of the charge transport substance include polycyclic aromatic compounds, heterocyclic compounds, hydrazone compounds, styryl compounds, enamine compounds, benzidine compounds, triarylamine compounds and resins having groups derived from these substances. Among these, the triarylamine compounds and the benzidine compounds are preferable.

Examples of the resin include polyester resin, acrylic resin, phenoxy resin, polycarbonate resin, polystyrene resin, phenolic resin, melamine resin and epoxy resin. Especially the polycarbonate resin, the polyester resin and the acrylic resin are preferable.

The average film thickness of the protective layer is preferably 0.5 μm or more and 10 μm or less, and preferably 1 μm or more and 7 μm or less.

The protective layer can be formed by preparing a coating liquid for the protective layer, wherein the coating liquid contains the above-mentioned materials and a solvent, forming a coating film thereof and drying and/or curing the coating film. Examples of the solvent used for the coating liquid include alcohol-based solvents, ketone-based solvents, ether-based solvents, sulfoxide-based solvents, ester-based solvents and aromatic hydrocarbon-based solvents.

[Process Cartridge and Electrophotographic Apparatus]

A process cartridge of the present invention is characterized by integrally supporting the electrophotographic photosensitive member described above and at least one unit selected from the group consisting of a charging unit, a development unit, a transfer unit and a cleaning unit and being detachably attachable to the main body of an electrophotographic apparatus.

An electrophotographic apparatus of the present invention is characterized by having the electrophotographic photosensitive member described above, the charging unit, an exposure unit, the development unit and the transfer unit.

An example of the schematic structure of the electrophotographic apparatus having the process cartridge including the electrophotographic photosensitive member is illustrated in FIGURE.

Reference numeral 1 is a cylindrical electrophotographic photosensitive member, and is driven rotationally at a predetermined circumferential speed in the direction of an arrow around a shaft 2. The surface of the electrophotographic photosensitive member 1 is charged at predetermined positive or negative potential by a charging unit 3. In the FIGURE, although a roller charging method by the roller-shaped charging member is illustrated, a charging method such as a corona charging method, a proximity electrification method or an injection charging method may be adopted. The surface of a charged electrophotographic photosensitive member 1 is irradiated with exposure light 4 from an exposure unit (not illustrated), and the electrostatic latent image corresponding to target image information is formed. The electrostatic latent image formed on the surface of the electrophotographic photosensitive member 1 is developed with toner stored in a development unit 5, and a toner image is formed on the surface of the electrophotographic photosensitive member 1. The toner image formed on the surface of electrophotographic photosensitive member 1 is transferred to a transfer material 7 by a transfer unit 6. The transfer material 7 to which the toner image is transferred is conveyed to a fixing unit 8, subjected to the fixing treatment of the toner image, and printed out of the electrophotographic apparatus. The electrophotographic apparatus may have a cleaning unit 9 for removing a deposit such as toner remaining on the surface of electrophotographic photosensitive member 1 after transfer. A so-called cleanerless system in which no cleaning unit is provided separately, but the above-mentioned deposit is removed by the development unit or the like may be used. The electrophotographic apparatus may have a discharging mechanism which subjects the surface of electrophotographic photosensitive member 1 to discharge treatment by pre-exposure light 10 from a pre-exposure unit (not illustrated). To detach a process cartridge 11 of the present invention from the main body of the electrophotographic apparatus, guiding units 12 such as rails may be provided.

An electrophotographic photosensitive member of the present invention can be used for laser beam printers, LED printers, copying machines, facsimiles, multifunctional machines thereof and the like.

EXAMPLES

The present invention will be described in further detail hereinafter using Examples and Comparative Examples. The present invention is not limited at all by the following Examples as long as the invention does not exceed the gist thereof. In the description of the following Examples, "part" is based on mass unless otherwise specified.

Manufacturing of Electrophotographic Photosensitive Member

Example 1

An aluminum cylinder (JIS-A3003, aluminium alloy) measuring 24 mm in diameter and 257.5 mm in length was used as a support (electro-conductive support).

Next, a sand mill using 450 parts of glass beads of 0.8 mm in diameter was charged with 214 parts of a titanium oxide ($TiO_2$) particle covered with oxygen-deficient tin oxide ($SnO_2$) as a metal oxide particle (230 nm in average primary particle size), 132 parts of phenolic resin (the monomer/oligomer of phenolic resin) (trade name: Plyophen J-325, produced by DIC Corporation, resin solid content: 60% by mass) as a binder material and 98 parts of 1-methoxy-2-propanol as a solvent. The mixture was subjected to dispersion treatment under the conditions that number of revolutions: 2000 rpm, dispersion treatment time: 4.5 hours, and set temperature of cooling water: 18° C. to obtain a dispersion. The glass beads were removed from this dispersion through a mesh (opening size: 150 μm).

A silicone resin particle (trade name: toss pearl 120, produced by Momentive Performance Materials Inc., 2 μm in average particle diameter) as a surface-roughening material was added to the dispersion so that the concentration of the silicone resin particle was 10% by mass based on the total mass of the metal oxide particle and the binder material in the dispersion after the glass beads were removed. Silicone oil (trade name: SH28PA, produced by Dow Corning Toray Co., Ltd.) as a leveling agent was added to the dispersion so that the concentration of the silicone oil was 0.01% by mass based on the total mass of the metal oxide particle and the binder material in the dispersion. Next, a coating liquid for an electro-conductive layer was prepared by adding a mixed solvent of methanol and 1-methoxy-2-propanol (mass ratio 1:1) to the dispersion so that the total mass of the metal oxide particle, the binder material and the surface-roughening material in the dispersion (namely, mass of solid content) was 67% by mass based on the mass of the dispersion and stirring the mixture. An electro-conductive layer having a film thickness of 30 μm was formed by subjecting the support to dip coating with this coating liquid for an electro-conductive layer and heating this for 1 hour at 140° C.

Next, 4 parts of an electron transport substance represented by the following structural formula (E-1), 5.5 parts of blocked isocyanate (trade name: DURANATE SBN-70D, produced by Asahi Kasei Chemicals Corporation), 0.3 parts of polyvinyl butyral resin (S-LEC KS-5Z, produced by SEKISUI CHEMICAL CO., LTD.) and 0.05 parts of zinc (II) hexanoate (produced by Mitsuwa Chemicals Co., Ltd.) as a catalyst were dissolved in a mixed solvent of 50 parts of tetrahydrofuran and 50 parts of 1-methoxy-2-propanol to prepare a coating liquid for an undercoating layer. An undercoating layer having a film thickness of 0.7 μm was formed by subjecting the electro-conductive layer to dip coating with this coating liquid for an undercoating layer and heating this for 30 minutes at 170° C.

(E-1)

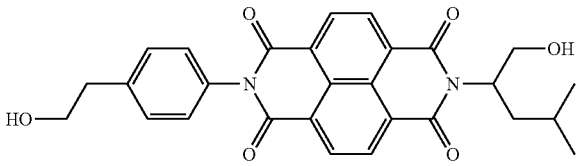

Next, 10 parts of crystalline hydroxygallium phthalocyanine having peaks at 7.5° and 28.4° in a chart obtained by CuKc characteristic X-ray diffraction and 5 parts of polyvinyl butyral resin (trade name: S-LEC BX-1, produced by SEKISUI CHEMICAL CO., LTD.) were added to 200 parts of cyclohexanone. The mixture was dispersed for 6 hours with a sand mill apparatus using glass beads of 0.9 mm in diameter. Then, 150 parts of cyclohexanone and 350 parts of ethyl acetate were further added to this, and diluted the mixture to obtain a coating liquid for a charge-generating layer. A charge-generating layer having a film thickness of 0.20 μm was formed by subjecting the undercoating layer to dip coating with the obtained coating liquid and drying the coating film at 95° C. for 10 minutes. The measurement of X-ray diffraction was performed under the following conditions.

[Powder X-Ray Diffraction Measurement]

Measuring machine used: X-ray diffraction apparatus RINT-TTR II manufactured by Rigaku Corporation,
X-ray tube: Cu
Tube voltage: 50 kV
Tube current: 300 mA
Scanning method: 2θ/θ scan
Scanning speed: 4.0°/min
Sampling interval: 0.02°
Start angle (2θ): 5.0°
Stop angle (2θ): 40.0°
Attachment: Standard sample holder
Filter: Not used
Incident monochrome: Used
Counter monochrome meter: Not used
Divergence slit: Open
Divergence vertical limit slit: 10.00 mm
Scattering slit: Open
Light-receiving slit: Open
Flat plate monochromator: Used
Counter: Scintillation counter Next, a coating liquid for a charge transport layer was prepared by dissolving 6 parts of a charge transport substance represented by the following structural formula (C-1) (hole transport substance), 3 parts of a charge transport substance represented by the following structural formula (C-2) (hole transport substance), 1 part of a charge transport substance represented by the following structural formula (C-3) (hole transport substance), 10 parts of polycarbonate (trade name: Iupilon Z400, produced by Mitsubishi Engineering-Plastics Corporation), and 0.02 parts of polycarbonate resin having copolymerization units represented by the following structural formula (C-4) and the following structural formula (C-5) (x/y=0.95/0.05: viscosity average molecular weight=20000) in a mixed solvent of 25 parts of ortho-xylene/25 parts of methyl benzoate/25 parts of dimethoxymethane. A charge transport layer having a film thickness of 12 μm was formed by subjecting the charge-generating layer to dip coating with this coating liquid for a charge transport layer, forming a coating film and drying the coating film for 30 minutes at 120° C.

(C-1)

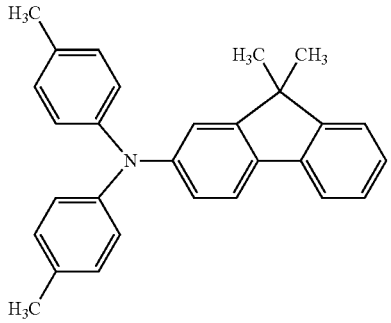

(C-2)

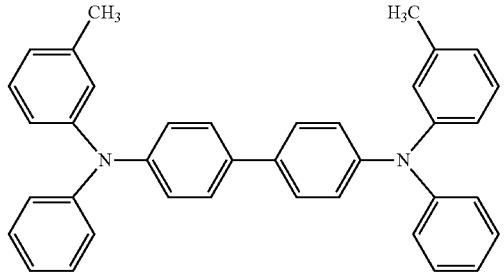

-continued (C-3)

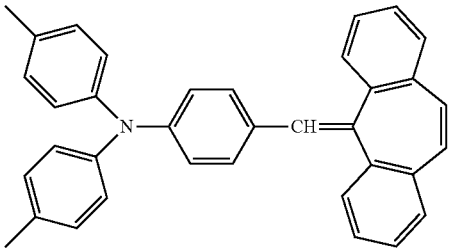

(C-4)

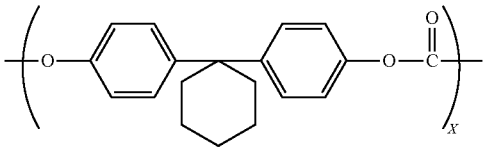

(C-5)

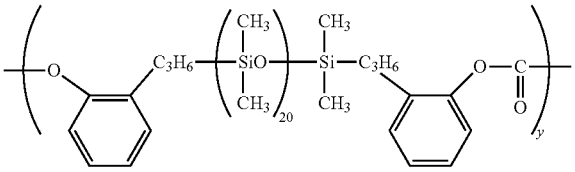

Next, 9 parts of a compound represented by the following structural formula (OCL-1), 9 parts of a compound represented by the following structural formula (L-1) and 2 parts of the compound represented by the above-mentioned structural formula (6-1) were mixed with a mixed solvent of 72 parts of 2-propanol and 8 parts of tetrahydrofuran, and the mixture was stirred. Thus, a coating liquid for a protective layer was prepared.

A coating film was formed by subjecting the charge transport layer to dip coating with this coating liquid for a protective layer, and the obtained coating film was dried for 6 minutes at 50° C. Then, the coating film was irradiated with an electron beam for 1.6 seconds while the support (object to be irradiated) was rotated at a speed of 300 rpm in a nitrogen atmosphere under the conditions of an accelerating voltage of 70 kV and a beam current of 2.0 mA. The oxygen concentration in electron beam irradiation was 810 ppm. Next, the coating film was naturally cooled in the air atmosphere until the temperature of the coating film reached 25° C., and heat treatment was then performed for 1 hour on the conditions that the temperature of the coating film reached 120° C. to form a protective layer having a film thickness of 3 μm. Thus, the cylindrical (drum-shaped) electrophotographic photosensitive member having the protective layer of Example 1 was manufactured.

Example 2

An electrophotographic photosensitive member was manufactured in the same way as in Example 1 except that the amount of the compound represented by the structural formula (OCL-1) was changed to 9.9 parts, the amount of the compound represented by the structural formula (L-1) was changed to 9.9 parts, and the amount of the compound represented by the structural formula (6-1) was changed to 0.2 parts in Example 1.

Example 3

An electrophotographic photosensitive member was manufactured in the same way as in Example 1 except that the amount of the compound represented by the structural formula (OCL-1) was changed to 7 parts, the amount of the compound represented by the structural formula (L-1) was (OCL-1)

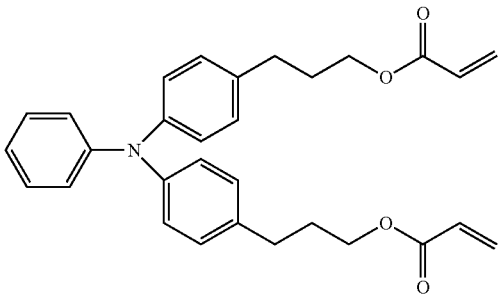

(L-1)

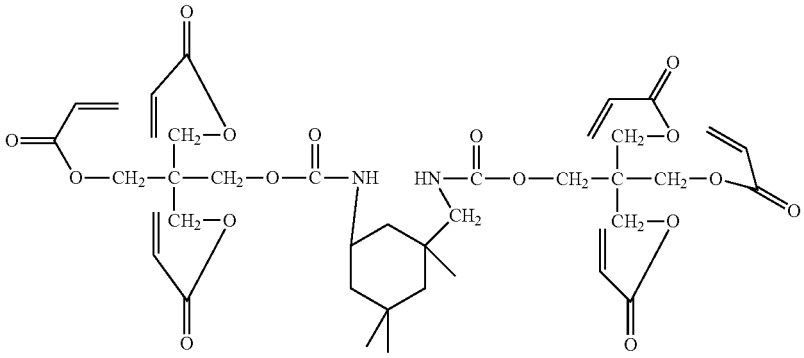

changed to 7 parts, and the amount of the compound represented by the structural formula (6-1) was changed to 6 parts in Example 1.

Example 4

An electrophotographic photosensitive member was manufactured in the same way as in Example 1 except that the compound represented by the structural formula (6-1) was changed to the compound represented by the structural formula (6-2) in Example 1.

Example 5

An electrophotographic photosensitive member was manufactured in the same way as in Example 1 except that the compound represented by the structural formula (6-1) was changed to the compound represented by the structural formula (6-3) in Example 1.

Example 6

An electrophotographic photosensitive member was manufactured in the same way as in Example 1 except that the amount of the compound represented by the structural formula (OCL-1) was changed to 10 parts, the amount of the compound represented by the structural formula (L-1) was changed to 10 parts, and the amount of the compound represented by the structural formula (6-1) was not used in Example 1.

Example 7

An electrophotographic photosensitive member was manufactured in the same way as in Example 6 except that the amount of the compound represented by the structural formula (OCL-1) was changed to 16 parts, the amount of the compound represented by the structural formula (L-1) was changed to 4 parts in Example 6.

Example 8

An electrophotographic photosensitive member was manufactured in the same way as in Example 6 except that the amount of the compound represented by the structural formula (OCL-1) was changed to 14 parts, the amount of the compound represented by the structural formula (L-1) was changed to 6 parts in Example 6.

Example 9

An electrophotographic photosensitive member was manufactured in the same way as in Example 6 except that the amount of the compound represented by the structural formula (OCL-1) was changed to 6 parts, the amount of the compound represented by the structural formula (L-1) was changed to 14 parts in Example 6.

Example 10

An electrophotographic photosensitive member was manufactured in the same way as in Example 6 except that the compound represented by the structural formula (OCL-1) was changed to a compound represented by the following structural formula (OCL-2) in Example 6.

(OCL-2)

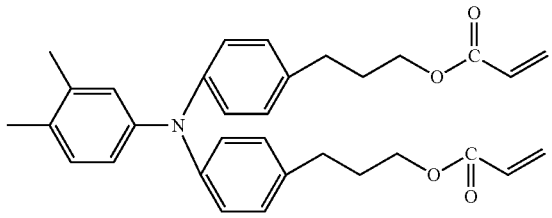

Example 11

An electrophotographic photosensitive member was manufactured in the same way as in Example 6 except that the compound represented by the structural formula (L-1) was changed to a compound represented by the following structural formula (L-2) in Example 6.

(L-2)

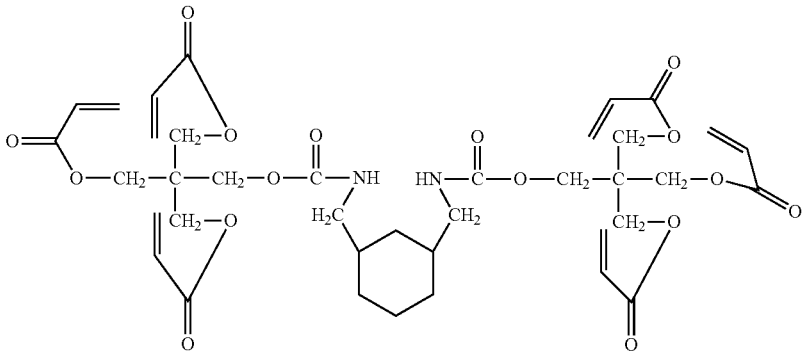

Example 12

An electrophotographic photosensitive member was manufactured in the same way as in Example 6 except that the compound represented by the structural formula (L-1) was changed to a compound represented by the following structural formula (L-3) in Example 6.

(L-3)

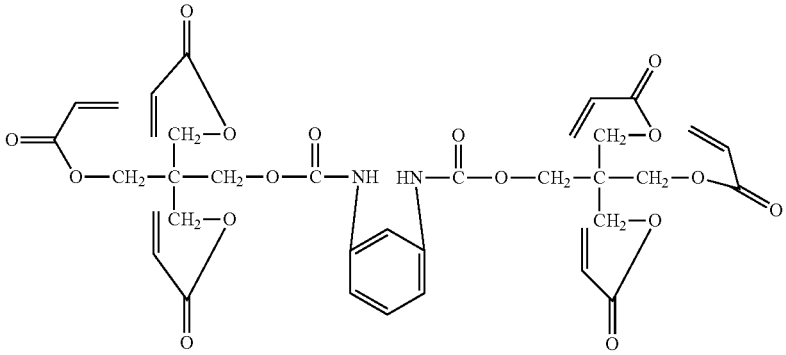

Example 13

An electrophotographic photosensitive member was manufactured in the same way as in Example 6 except that the compound represented by the structural formula (L-1) was changed to a compound represented by the following structural formula (L-4) in Example 6.

(L-4)

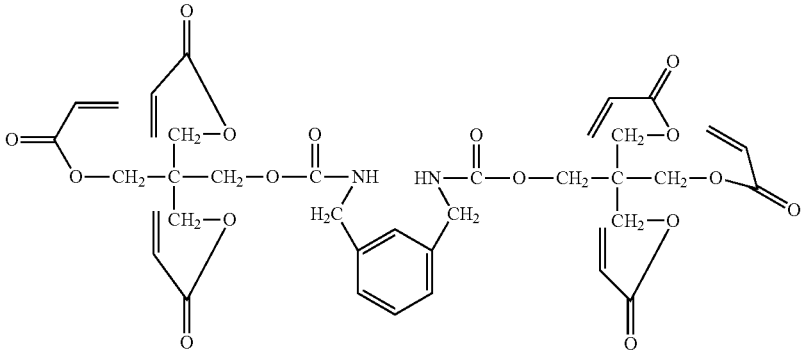

Example 14

An electrophotographic photosensitive member was manufactured in the same way as in Example 6 except that the compound represented by the structural formula (L-1) was changed to a compound represented by the following structural formula (L-5) in Example 6.

(L-5)

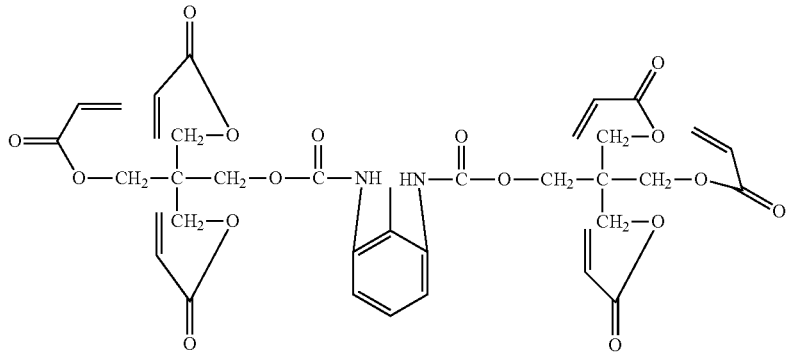

Example 15

An electrophotographic photosensitive member was manufactured in the same way as in Example 6 except that the compound represented by the structural formula (L-1) was changed to a compound represented by the following structural formula (L-6) in Example 6.

(L-6)

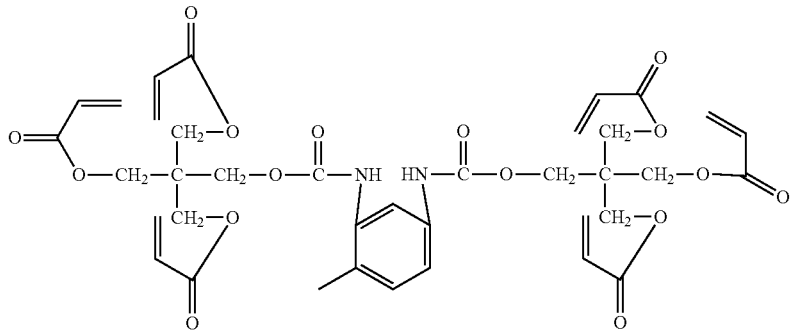

Example 16

An electrophotographic photosensitive member was manufactured in the same way as in Example 6 except that the compound represented by the structural formula (L-1) was changed to a compound represented by the following structural formula (L-7) in Example 6.

(L-7)

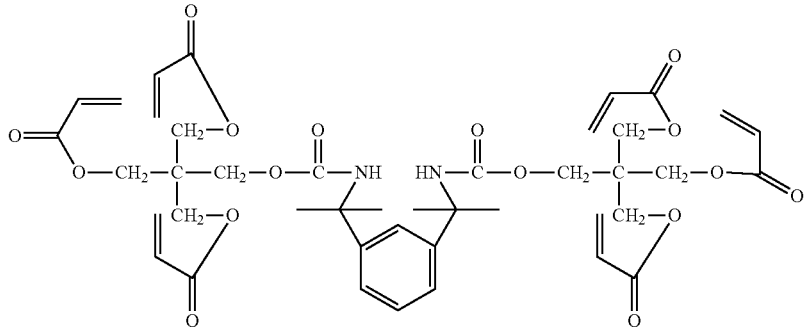

Example 17

An electrophotographic photosensitive member was manufactured in the same way as in Example 6 except that the compound represented by the structural formula (L-1) was changed to a compound represented by the following structural formula (L-8) in Example 6.

Example 18

(L-8)

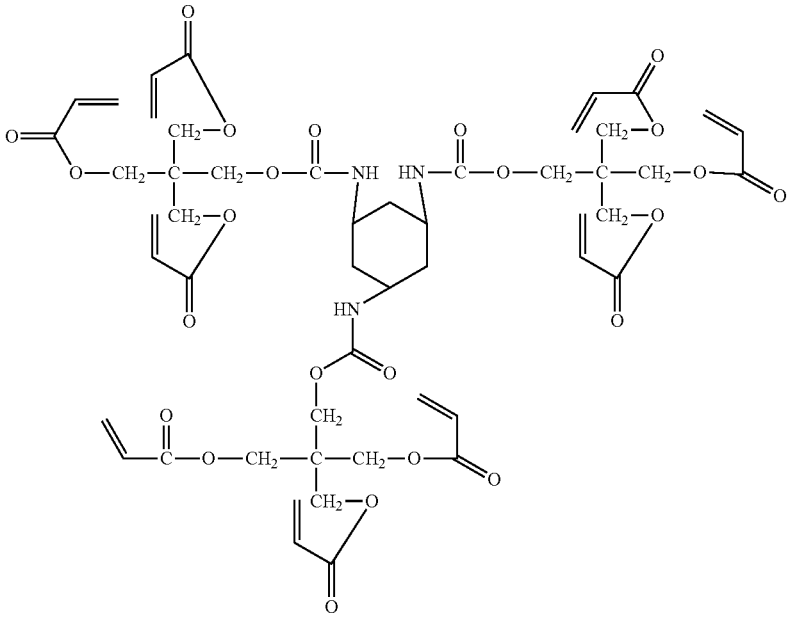

An electrophotographic photosensitive member was manufactured in the same way as in Example 6 except that the oxygen concentration at the time of electron beam irradiation was changed to 320 ppm, and the beam current was changed to 5.0 mA in Example 6.

Example 19

An electrophotographic photosensitive member was manufactured in the same way as in Example 6 except that the oxygen concentration at the time of electron beam irradiation was changed to 680 ppm, and the beam current was changed to 4.0 mA in Example 6.

Example 20

An electrophotographic photosensitive member was manufactured in the same way as in Example 6 except that the oxygen concentration at the time of electron beam irradiation was changed to 960 ppm, and the irradiation time was changed to 0.8 seconds in Example 6.

Example 21

An electrophotographic photosensitive member was manufactured in the same way as in Example 6 except that the oxygen concentration at the time of electron beam irradiation was changed to 980 ppm, and the irradiation time was changed to 0.6 seconds in Example 6.

Comparative Example 1

An electrophotographic photosensitive member of Comparative Example 1 was obtained in the same way as in Example 6 except that the compound represented by the structural formula (L-1) was changed to a compound represented by the following structural formula (L-9) in Example 6.

(L-9)

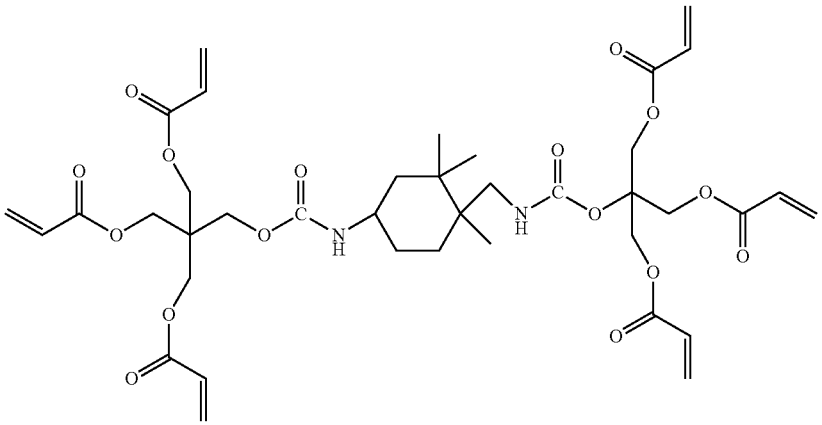

Comparative Example 2

An electrophotographic photosensitive member was manufactured in the same way as in Example 6 except that the oxygen concentration at the time of electron beam irradiation was changed to 500 ppm, the accelerating voltage was changed to 90 kV, the beam current was changed to 15.0 mA, and the irradiation time was changed to 2.4 seconds in Example 6.

Comparative Example 3

An electrophotographic photosensitive member was manufactured in the same way as in Example 6 except that the oxygen concentration at the time of electron beam irradiation was changed to 500 ppm, the accelerating voltage was changed to 90 kV, the beam current was changed to 15.0 mA, and the irradiation time was changed to 1.2 seconds in Example 6.

Comparative Example 4

An electrophotographic photosensitive member was manufactured in the same way as in Example 6 except that the oxygen concentration at the time of electron beam irradiation was changed to 500 ppm, the accelerating voltage was changed to 90 kV, the beam current was changed to 6.0 mA, and the irradiation time was changed to 1.2 seconds in Example 6.

Comparative Example 5

An electrophotographic photosensitive member was manufactured in the same way as in Example 6 except that the oxygen concentration at the time of electron beam irradiation was changed to 500 ppm, the accelerating voltage was changed to 90 kV, the beam current was changed to 3.0 mA, and the irradiation time was changed to 1.2 seconds in Example 6.

Comparative Example 6

An electrophotographic photosensitive member was manufactured in the same way as in Example 6 except that the oxygen concentration at the time of electron beam irradiation was changed to 980 ppm, and the irradiation time was changed to 0.2 seconds in Example 6.

<Electron Beam Irradiation Conditions>

The electron beam irradiation conditions of the photosensitive members manufactured in Examples 1 to 21 and Comparative Examples 1 to 6 are illustrated in the following Table 1.

TABLE 1

| | Electron beam irradiation conditions | | | | |
|---|---|---|---|---|---|
| | Oxygen concentration (ppm) | Voltage value (kV) | Current value (mA) | Irradiation time (s) | Heating in the air atmosphere (° C.) |
| Example 1 | 810 | 70 | 2 | 1.6 | 120 |
| Example 2 | 810 | 70 | 2 | 1.6 | 120 |
| Example 3 | 810 | 70 | 2 | 1.6 | 120 |
| Example 4 | 810 | 70 | 2 | 1.6 | 120 |
| Example 5 | 810 | 70 | 2 | 1.6 | 120 |
| Example 6 | 810 | 70 | 2 | 1.6 | 120 |
| Example 7 | 810 | 70 | 2 | 1.6 | 120 |
| Example 8 | 810 | 70 | 2 | 1.6 | 120 |
| Example 9 | 810 | 70 | 2 | 1.6 | 120 |
| Example 10 | 810 | 70 | 2 | 1.6 | 120 |
| Example 11 | 810 | 70 | 2 | 1.6 | 120 |
| Example 12 | 810 | 70 | 2 | 1.6 | 120 |
| Example 13 | 810 | 70 | 2 | 1.6 | 120 |
| Example 14 | 810 | 70 | 2 | 1.6 | 120 |
| Example 15 | 810 | 70 | 2 | 1.6 | 120 |
| Example 16 | 810 | 70 | 2 | 1.6 | 120 |
| Example 17 | 810 | 70 | 2 | 1.6 | 120 |
| Example 18 | 320 | 70 | 5 | 1.6 | 120 |
| Example 19 | 680 | 70 | 4 | 1.6 | 120 |
| Example 20 | 960 | 70 | 2 | 0.8 | 120 |
| Example 21 | 980 | 70 | 2 | 0.6 | 120 |
| Comparative Example 1 | 810 | 70 | 2 | 1.6 | 120 |
| Comparative Example 2 | 500 | 90 | 15 | 2.4 | 120 |
| Comparative Example 3 | 500 | 90 | 15 | 1.2 | 120 |
| Comparative Example 4 | 500 | 90 | 6 | 1.2 | 120 |
| Comparative Example 5 | 500 | 90 | 3 | 1.2 | 120 |
| Comparative Example 6 | 980 | 70 | 2 | 0.2 | 120 |

<Analysis>

The photosensitive members manufactured in Examples 1 to 21 and Comparative Examples 1 to 6 were used and analyzed under the following conditions.

The surface of an obtained electrophotographic photosensitive member was scraped with a razor to obtain the protective layer. This protective layer was first dipped in chloroform, and compounds were extracted by drying. The content of the triarylamine compound was confirmed by performing the 1H-NMR measurement (apparatus: manufactured by Bruker Corporation, AVANCE III 500) of this compound and analyzing data. Next, the protective layer dipped in chloroform was dried and measured by pyrolysis gas chromatography. In this measurement, the molar ratio of the cyclic structure to the triphenyl amine structure and the molar ratio of the structure represented by the general formula (5) to the cyclic structure were determined by drawing a calibration curve.

The elastic deformation rate was measured under the environment of a temperature of 23° C. and a humidity of 50% RH using the Fischer hardness tester (trade name: H100VP-HCU, manufactured by FISCHER INSTRUMENTS K.K.). A Vickers pyramid diamond indenter having an angle between the opposite faces of 136° was thrust into the protective layer surface of a measuring object using the diamond indenter as an indenter. A load was applied to 2 mN over 7 seconds and reduced gradually over 7 seconds. The indentation depth until the load was 0 mN was measured continuously. The elastic deformation rate was determined from the result.

Next, the A value was determined by measuring an infrared spectroscopic spectrum on the surface of an electrophotographic photosensitive member under the following conditions using total reflection Fourier transform infrared spectroscopy. S1 was defined as a peak area from 1413 $cm^{-1}$ to 1400 $cm^{-1}$, and S2 was defined as a peak area from 1770 $cm^{-1}$ to 1700 $cm^{-1}$.

(Measurement Conditions)

Apparatus: FT/IR-420 (manufactured by JASCO Corporation)

Attached apparatus: ATR apparatus

IRE (internal reflection element): Ge

Incidence angle: 45°

Number of integration times: 320

The analysis results are described in the following Table 2.

TABLE 2

| | Analysis result | | | | | | | |
|---|---|---|---|---|---|---|---|---|
| | Monomer having triarylamine structure | Monomer having cyclic structure | Molar ratio of cyclic structure to triarylamine structure | Molar ratio of structure represented by general formula (5) to cyclic structure | Triarylamine compound | Content of triarylamine compound based on protective layer (% by mass) | Elastic deformation rate (%) | A value |
| Example 1 | OCL-1 | L-1 | 0.57 | 2.0 | (6-1) | 10% | 43 | 0.0841 |
| Example 2 | OCL-1 | L-1 | 0.57 | 2.0 | (6-1) | 1% | 44 | 0.0798 |
| Example 3 | OCL-1 | L-1 | 0.57 | 2.0 | (6-1) | 30% | 40 | 0.0838 |
| Example 4 | OCL-1 | L-1 | 0.57 | 2.0 | (6-2) | 10% | 42 | 0.0820 |
| Example 5 | OCL-1 | L-1 | 0.57 | 2.0 | (6-3) | 10% | 43 | 0.0861 |
| Example 6 | OCL-1 | L-1 | 0.57 | 2.0 | — | — | 42 | 0.0790 |
| Example 7 | OCL-1 | L-1 | 0.14 | 2.0 | — | — | 41 | 0.0815 |
| Example 8 | OCL-1 | L-1 | 0.25 | 2.0 | — | — | 43 | 0.0822 |
| Example 9 | OCL-1 | L-1 | 1.34 | 2.0 | — | — | 48 | 0.0877 |
| Example 10 | OCL-2 | L-1 | 0.61 | 2.0 | — | — | 43 | 0.0796 |
| Example 11 | OCL-1 | L-2 | 0.60 | 2.0 | — | — | 42 | 0.0829 |
| Example 12 | OCL-1 | L-3 | 0.62 | 2.0 | — | — | 46 | 0.0841 |
| Example 13 | OCL-1 | L-4 | 0.60 | 2.0 | — | — | 41 | 0.0883 |
| Example 14 | OCL-1 | L-5 | 0.61 | 2.0 | — | — | 44 | 0.0799 |
| Example 15 | OCL-1 | L-6 | 0.61 | 2.0 | — | — | 44 | 0.0831 |
| Example 16 | OCL-1 | L-7 | 0.56 | 2.0 | — | — | 45 | 0.0834 |
| Example 17 | OCL-1 | L-8 | 0.43 | 3.0 | — | — | 48 | 0.0869 |
| Example 18 | OCL-1 | L-1 | 0.57 | 2.0 | — | — | 50 | 0.0653 |
| Example 19 | OCL-1 | L-1 | 0.57 | 2.0 | — | — | 49 | 0.0758 |
| Example 20 | OCL-1 | L-1 | 0.57 | 2.0 | — | — | 44 | 0.0949 |
| Example 21 | OCL-1 | L-1 | 0.57 | 2.0 | — | — | 42 | 0.0982 |
| Comparative Example 1 | OCL-1 | L-9 | 0.57 | 2.0 | — | — | 41 | 0.0835 |
| Comparative Example 2 | OCL-1 | L-1 | 0.57 | 2.0 | — | — | 49 | 0.0512 |
| Comparative Example 3 | OCL-1 | L-1 | 0.57 | 2.0 | — | — | 48 | 0.0549 |
| Comparative Example 4 | OCL-1 | L-1 | 0.57 | 2.0 | — | — | 48 | 0.0584 |
| Comparative Example 5 | OCL-1 | L-1 | 0.57 | 2.0 | — | — | 47 | 0.0633 |
| Comparative Example 6 | OCL-1 | L-1 | 0.57 | 2.0 | — | — | 36 | 0.1154 |

<Evaluation: Abrasion Resistance>

The abrasion resistance was evaluated under the following conditions using the photosensitive members manufactured in Examples 1 to 21 and Comparative Examples 1 to 6. A laser beam printer manufactured by HP Inc. (trade name HP LaserJet Enterprise Color M553dn) was used as an evaluation apparatus, and the drive system was modified so that the rotation speed of an electrophotographic photosensitive member was 350 mm/sec. A cartridge was equipped with a manufactured electrophotographic photosensitive member, and 10,000 sheets were fed continuously using an A4 test pattern having a printing rate of 1% under the low temperature and humidity environment of a temperature of 15° C. and a relative humidity of 10%.

A spectral interference displacement type multilayer film thickness measuring instrument manufactured by KEYENCE CORPORATION (spectral unit: SI-T80) was used for measuring the film thickness. The total film thickness of the charge transport layer and the protective layer was determined by measuring the cylindrical electrophotographic photosensitive member in the direction of a generating line and the circumferential direction at intervals of 1 mm and taking an average. The difference between the film thicknesses before and after the continuous passing of sheets was calculated as the amount of the film thickness scraped (μm). When the amount of the film thickness scraped was 0.3 μm or less, it was determined that an effect of the present invention was obtained.

<Evaluation: Density Unevenness Among Output Images>

The density unevenness among output images was evaluated under the following conditions using the photosensitive members manufactured in Examples 1 to 21 and Comparative Examples 1 to 6. The above-mentioned laser beam printer in which the drive system was modified so that the rotation speed of an electrophotographic photosensitive member was 350 mm/sec was used as an evaluation apparatus. A cartridge was equipped with a manufactured electrophotographic photosensitive member, and 500 sheets were fed continuously using a halftone image under the normal temperature and humidity environment of a temperature of 23° C., and a relative humidity of 50%.

The density change between output images in 500-sheet passing was calculated by measuring the image densities of the first sheet and the five hundredth sheet by a spectral densitometer (trade name: X-Rite 504/508, manufactured by X-Rite Inc.). When the density change was 0.020 or less, it was determined that an effect of the present invention was obtained.

The evaluation results of abrasion resistance and density unevenness are illustrated in the following Table 3.

TABLE 3

| | Abrasion resistance | Density unevenness among output images | | |
|---|---|---|---|---|
| | Amount of film thickness scraped/ μm | First sheet image density | Five hundredth sheet image density | Density change |
| Example 1 | 0.222 | 0.468 | 0.462 | 0.006 |
| Example 2 | 0.219 | 0.462 | 0.453 | 0.009 |
| Example 3 | 0.234 | 0.482 | 0.478 | 0.004 |
| Example 4 | 0.228 | 0.471 | 0.463 | 0.008 |
| Example 5 | 0.225 | 0.469 | 0.462 | 0.007 |
| Example 6 | 0.204 | 0.459 | 0.446 | 0.013 |
| Example 7 | 0.237 | 0.467 | 0.456 | 0.011 |
| Example 8 | 0.210 | 0.464 | 0.449 | 0.015 |
| Example 9 | 0.186 | 0.442 | 0.428 | 0.014 |
| Example 10 | 0.219 | 0.456 | 0.444 | 0.012 |
| Example 11 | 0.237 | 0.459 | 0.447 | 0.012 |
| Example 12 | 0.234 | 0.457 | 0.444 | 0.013 |
| Example 13 | 0.240 | 0.462 | 0.448 | 0.014 |
| Example 14 | 0.222 | 0.463 | 0.451 | 0.012 |
| Example 15 | 0.228 | 0.459 | 0.444 | 0.015 |
| Example 16 | 0.237 | 0.453 | 0.440 | 0.013 |
| Example 17 | 0.270 | 0.463 | 0.445 | 0.018 |
| Example 18 | 0.186 | 0.459 | 0.441 | 0.018 |
| Example 19 | 0.192 | 0.461 | 0.447 | 0.014 |
| Example 20 | 0.261 | 0.462 | 0.449 | 0.013 |
| Example 21 | 0.279 | 0.458 | 0.446 | 0.012 |
| Comparative Example 1 | 0.324 | 0.461 | 0.438 | 0.023 |
| Comparative Example 2 | 0.159 | 0.458 | 0.431 | 0.027 |
| Comparative Example 3 | 0.162 | 0.464 | 0.440 | 0.024 |
| Comparative Example 4 | 0.171 | 0.464 | 0.441 | 0.023 |
| Comparative Example 5 | 0.183 | 0.457 | 0.435 | 0.022 |
| Comparative Example 6 | 0.345 | 0.458 | 0.442 | 0.016 |

Example 22

An electro-conductive layer, an undercoating layer, a charge-generating layer, and a charge transport layer were formed in the same way as in Example 1. Subsequently, 10 parts of the compound represented by the structural formula (OCL-1), 10 parts of the compound represented by the structural formula (L-1), 0.2 parts of a siloxane-modified acrylic compound (BYK-3550, produced by BYK Japan KK) and 1 part of a compound represented by the following structural formula (7) (1-hydroxy-cyclohexyl-phenyl-ketone) were mixed with a mixed solvent of 72 parts of 2-propanol and 8 parts of tetrahydrofuran, and the mixture was stirred. Thus, a coating liquid for a protective layer was prepared.

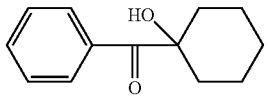

(7)

A coating film was formed by subjecting the charge transport layer to dip coating with this coating liquid for a protective layer, and the obtained coating film was dried for 6 minutes at 50° C. Then, the coating film was irradiated with ultraviolet rays in the air atmosphere for 2.0 seconds using an electrodeless lamp H bulb (manufactured by Heraeus K.K.) under the condition of a lamp intensity of 0.4 W/cm$^2$ while the support (object to be irradiated) was rotated at a speed of 300 rpm. Next, the coating film was cooled naturally in the air atmosphere until the temperature of the coating film reached 25° C. and the coating film was then subjected to heat-treatment for 1 hour under the conditions that the temperature of the coating film reached 120° C. to form a protective layer having a film thickness of 3 μm. Thus, a cylindrical (drum-shaped) electrophotographic photosensitive member having the protective layer of Example 22 was manufactured.

Example 23

An electrophotographic photosensitive member was manufactured in the same way as in Example 22 except that the lamp intensity at the time of ultraviolet irradiation was changed to 0.3 W/cm$^2$ in Example 22.

Example 24

An electrophotographic photosensitive member was manufactured in the same way as in Example 22 except that the lamp intensity at the time of ultraviolet irradiation was changed to 0.2 W/cm$^2$ in Example 22.

Comparative Example 7

An electrophotographic photosensitive member was manufactured in the same way as in Example 22 except that the lamp intensity at the time of ultraviolet irradiation was changed to 0.2 W/cm$^2$, and the irradiation time was changed to 20 seconds in Example 22.

Comparative Example 8

An electrophotographic photosensitive member was manufactured in the same way as in Example 22 except that the lamp intensity at the time of ultraviolet irradiation was changed to 0.6 W/cm$^2$ in Example 22.

<Ultraviolet Irradiation Conditions>

The ultraviolet irradiation conditions of the photosensitive members manufactured in Examples 22 to 24 and Comparative Examples 7 to 8 are described in the following Table 4.

TABLE 4

| | Ultraviolet irradiation conditions | | | |
|---|---|---|---|---|
| | Oxygen concentration | Lamp intensity (W/cm$^2$) | Irradiation time (s) | Heating in the air atmosphere (° C.) |
| Example 22 | 20.8% | 0.4 | 2 | 120 |
| Example 23 | 20.8% | 0.3 | 2 | 120 |
| Example 24 | 20.8% | 0.2 | 2 | 120 |
| Comparative Example 7 | 20.8% | 0.6 | 20 | 120 |
| Comparative Example 8 | 20.8% | 0.6 | 2 | 120 |

<Analysis>

The photosensitive members manufactured in Examples 22 to 24 and Comparative Examples 7 to 8 were analyzed in the same way as the photosensitive members manufactured in Examples 1 to 21 and Comparative Examples 1 to 6. The analysis results are described in the following Table 5.

TABLE 5

| | Analysis result | | | | | |
|---|---|---|---|---|---|---|
| | Monomer having triarylamine structure | Monomer having cyclic structure | Molar ratio of cyclic structure to triarylamine structure | Molar ratio of structure represented by general formula (5) to cyclic structure | Elastic deformation rate (%) | A value |
| Example 22 | OCL-1 | L-1 | 0.57 | 2.0 | 43 | 0.0771 |
| Example 23 | OCL-1 | L-1 | 0.57 | 2.0 | 43 | 0.0839 |
| Example 24 | OCL-1 | L-1 | 0.57 | 2.0 | 41 | 0.0934 |
| Comparative Example 7 | OCL-1 | L-1 | 0.57 | 2.0 | 49 | 0.0521 |
| Comparative Example 8 | OCL-1 | L-1 | 0.57 | 2.0 | 47 | 0.0619 |

[Evaluation]

The abrasion resistance and the density unevenness were evaluated in the same way as the photosensitive members manufactured in Examples 1 to 21 and Comparative Examples 1 to 6 using the photosensitive members manufactured in Examples 22 to 24 and Comparative Examples 7 to 8.

The evaluation results of abrasion resistance and density unevenness are illustrated in Table 6.

TABLE 6

| | Abrasion resistance | Density unevenness among output images | | |
|---|---|---|---|---|
| | Amount of film thickness scraped/ μm | First sheet image density | Five hundredth sheet image density | Density change |
| Example 22 | 0.204 | 0.461 | 0.446 | 0.015 |
| Example 23 | 0.237 | 0.457 | 0.444 | 0.013 |
| Example 24 | 0.261 | 0.462 | 0.450 | 0.012 |
| Comparative Example 7 | 0.162 | 0.458 | 0.431 | 0.027 |
| Comparative Example 8 | 0.180 | 0.455 | 0.432 | 0.023 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-035742, filed Feb. 28, 2018, which is hereby incorporated by reference herein in its entirety.

What is claimed is:

1. An electrophotographic photosensitive member, comprising:

an electro-conductive support, a photosensitive layer and a protective layer in this order, the protective layer comprising a resin having a triarylamine structure and a cyclic structure represented by formulae (1) or (2)

(1)

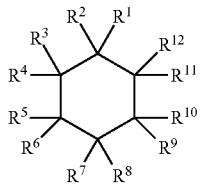

where at least two of $R^1$, $R^5$ and $R^9$ are represented by formula (3), and each of the substituents except the substituents represented by formula (3) in $R^1$ to $R^{12}$ is a hydrogen atom or a methyl group, (2)

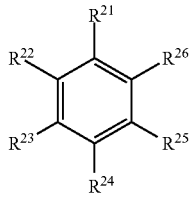

where at least two of $R^{21}$, $R^{23}$ and $R^{25}$ are represented by formula (3), and each of the substituents except the substituents represented by formula (3) in $R^{21}$ to $R^{26}$ is a hydrogen atom or a methyl group, (3)

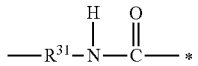

where $R^{31}$ is a single bond or an optionally substituted methylene group, $R^{31}$ bonds to a ring in the cyclic structure of formulae (1) or (2), and * represents having a bond, wherein the protective layer is formed as a cured film by polymerizing a composition containing a first monomer and a second monomer, wherein the first monomer is at least one selected from the group consisting of monomers of OCL-1 and OCL-2, and the second monomer is at least one selected from the group consisting of monomers of L-1, L-2, L-3, L-4, L-5, L-6, L-7 and L-8

(OCL-1)

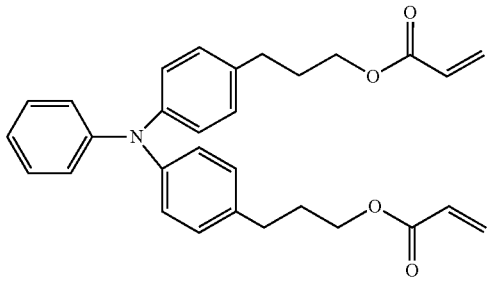

(OCL-2)

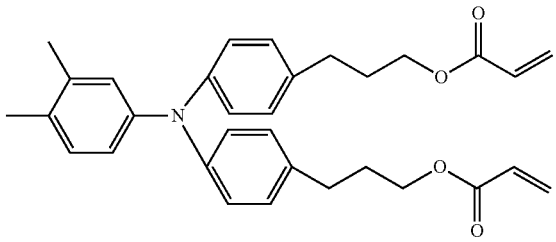

-continued (L-1)

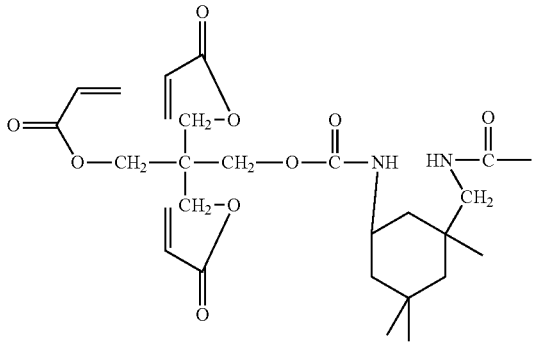

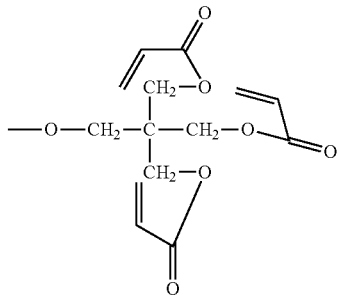

(L-2)

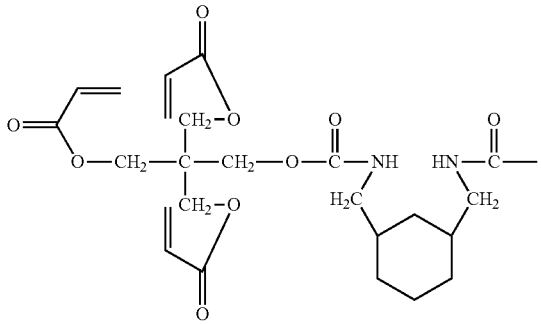

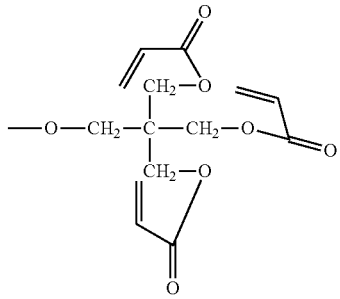

(L-3)

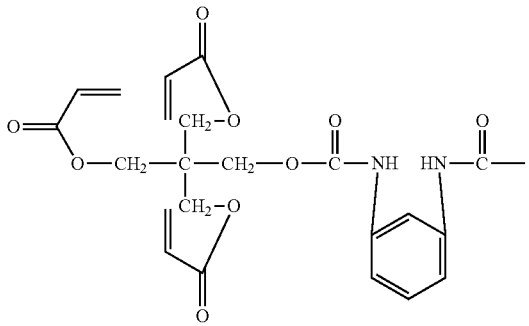

-continued
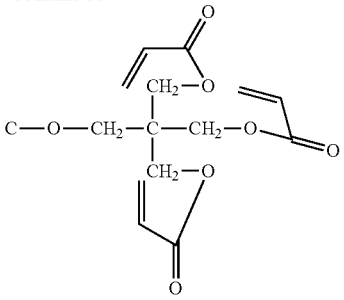
(L-4)
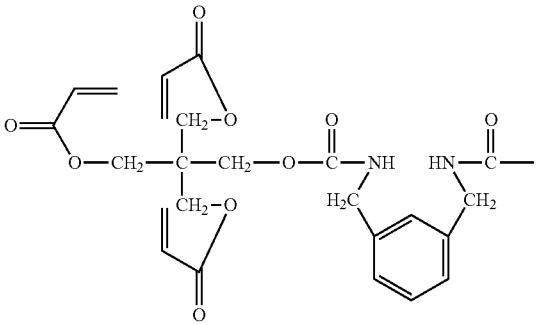
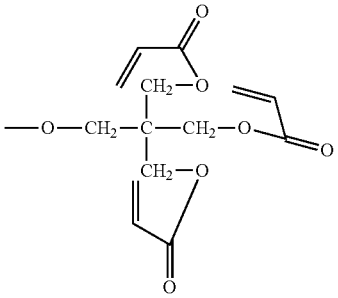
(L-5)
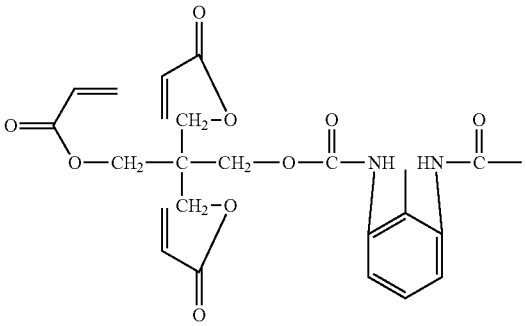
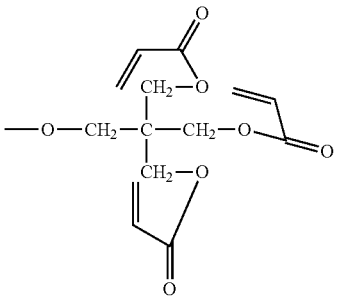
-continued
(L-6)
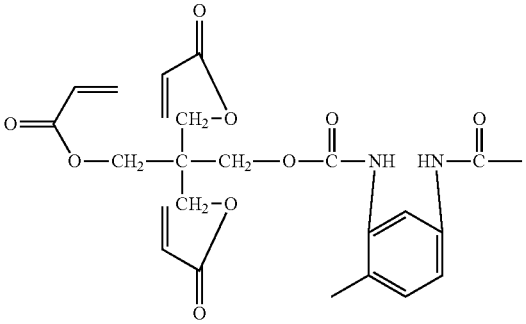
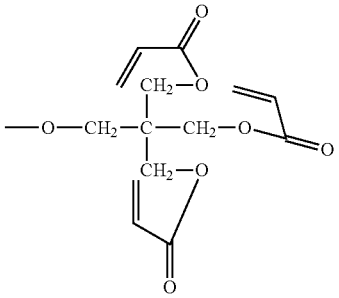
(L-7)
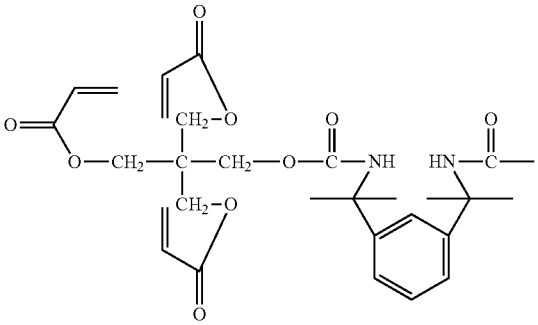
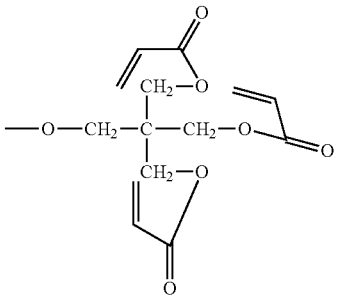

-continued (L-8)

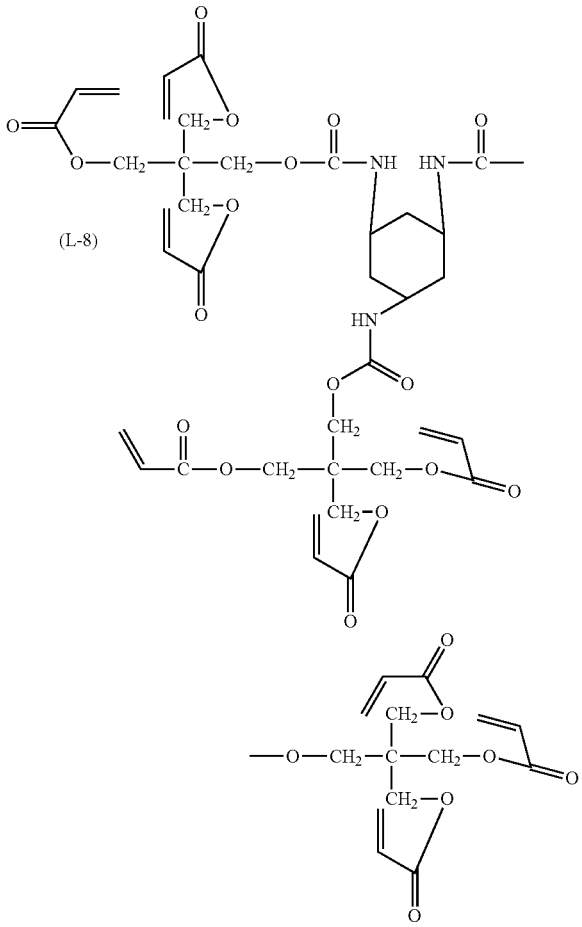

(L-8)

and A is 0.065 to 0.100 where A=S1/S2, and S1 and S2 each represent peak areas of a spectrum obtained by measuring a surface of the protective layer by total reflection Fourier transform infrared spectroscopy using Ge as an internal reflection element with a measurement condition of 45° as an incidence angle, when S1 is a peak area based on in-plane deformation vibration of terminal olefin, and S2 is a peak area based on stretching vibration of C=O.

2. The electrophotographic photosensitive member according to claim 1, wherein an elastic deformation rate of the protective layer is 40 to 50% as measured by thrusting a Vickers pyramid diamond indenter having an angle between opposite faces of 136° into the protective layer surface while applying a load of 2 mN over 7 seconds and then continuously gradually reducing the load over 7 seconds to 0 mN.

3. The electrophotographic photosensitive member according to claim 1, wherein a molar ratio of the cyclic structure to the triarylamine structure is 0.2 to 1.4.

4. The electrophotographic photosensitive member according to claim 1, wherein the protective layer further comprises a triarylamine compound having no polymerizable functional group, and having a molecular weight of 300 to 1000.

5. The electrophotographic photosensitive member according to claim 4, wherein the protective layer comprises 1 to 30% by mass of the triarylamine compound having no polymerizable functional group, based on a total mass of the protective layer.

6. A process cartridge integrally supporting an electrophotographic photosensitive member and at least one unit selected from the group consisting of a charging unit, a development unit, a transfer unit and a cleaning unit, and being detachably attachable to a main body of an electrophotographic apparatus, the electrophotographic photosensitive member comprising an electro-conductive support, a photosensitive layer and a protective layer in this order, the protective layer comprising a resin having a triarylamine structure and a cyclic structure represented by formulae (1) or (2)

(1)

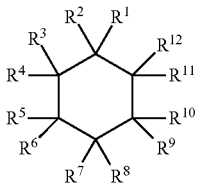

where at least two of $R^1$, $R^5$ and $R^9$ are represented by formula (3), and each of the substituents except the substituents represented by formula (3) in $R^1$ to $R^{12}$ is a hydrogen atom or a methyl group, (2)

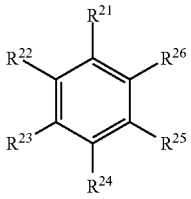

where at least two of $R^{21}$, $R^{23}$ and $R^{25}$ are represented by formula (3), and each of the substituents except the substituents represented by formula (3) in $R^{21}$ to $R^{26}$ is a hydrogen atom or a methyl group, (3)

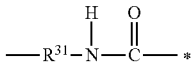

where $R^{31}$ is a single bond or an optionally substituted methylene group, $R^{31}$ bonds to a ring in the cyclic structure of formulae (1) or (2), and * represents having a bond, wherein the protective layer is formed as a cured film by polymerizing a composition containing a first monomer and a second monomer, wherein the first monomer is at least one selected from the group consisting of monomers of OCL-1 and OCL-2, and the second monomer is at least one selected from the group consisting of monomers of L-1, L-2, L-3, L-4, L-5, L-6, L-7 and L-8

(OCL-1)
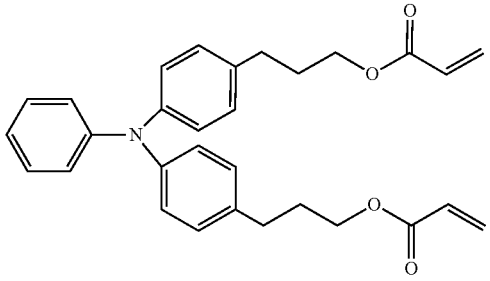
(OCL-2)
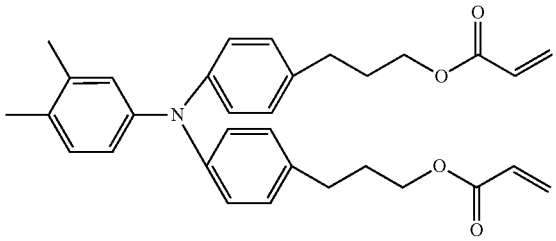
(L-1)
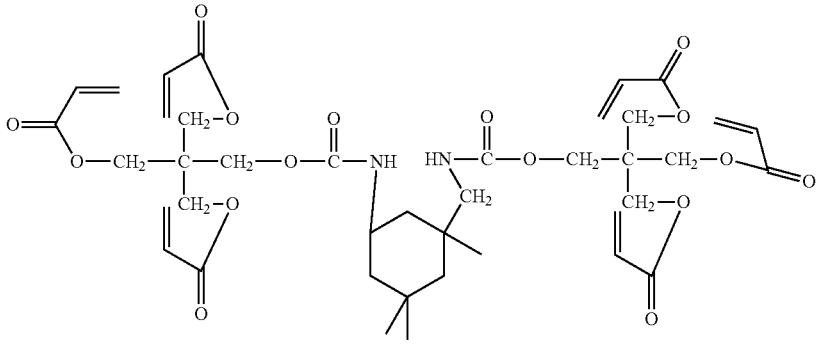
(L-2)
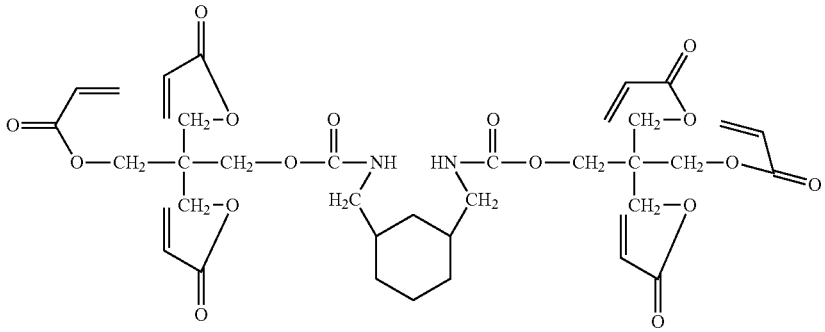
(L-3)
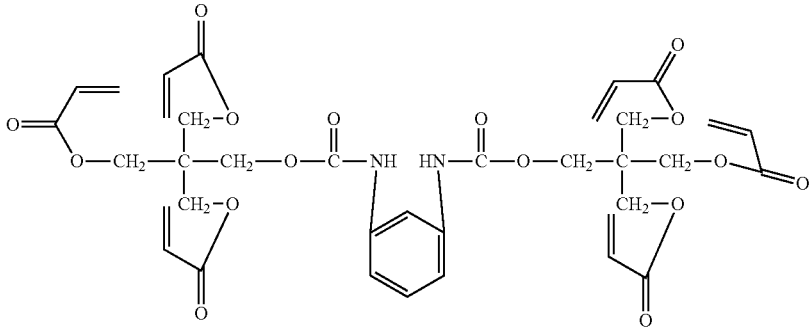

-continued
(L-4)
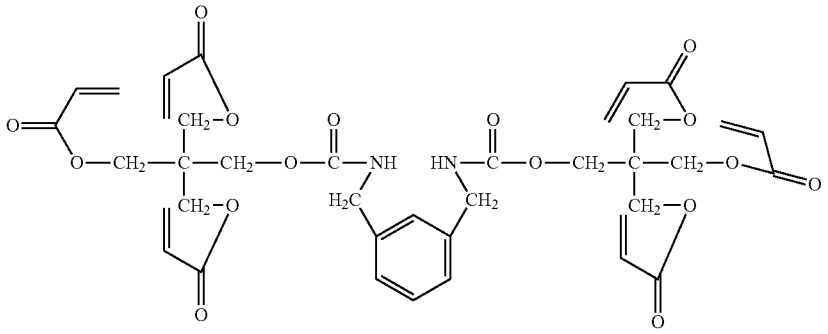
(L-5)
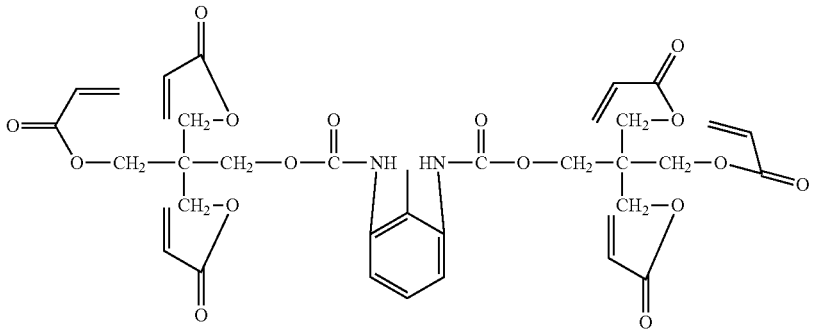
(L-6)
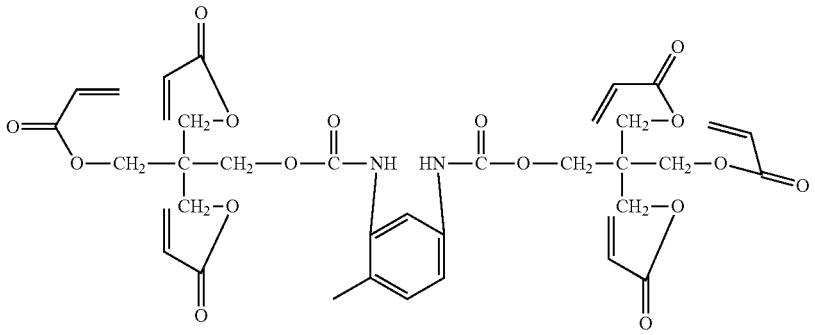
(L-7)
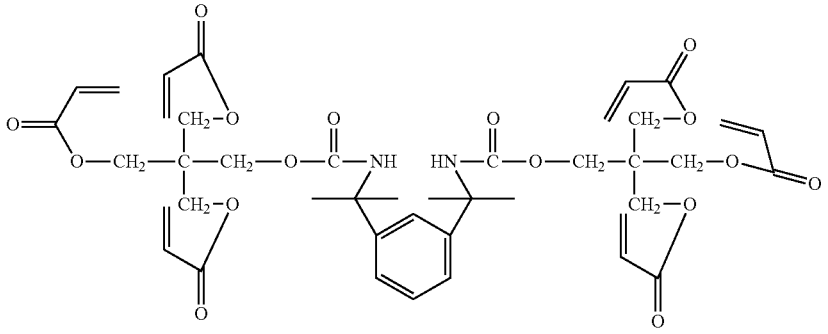

-continued (L-8)

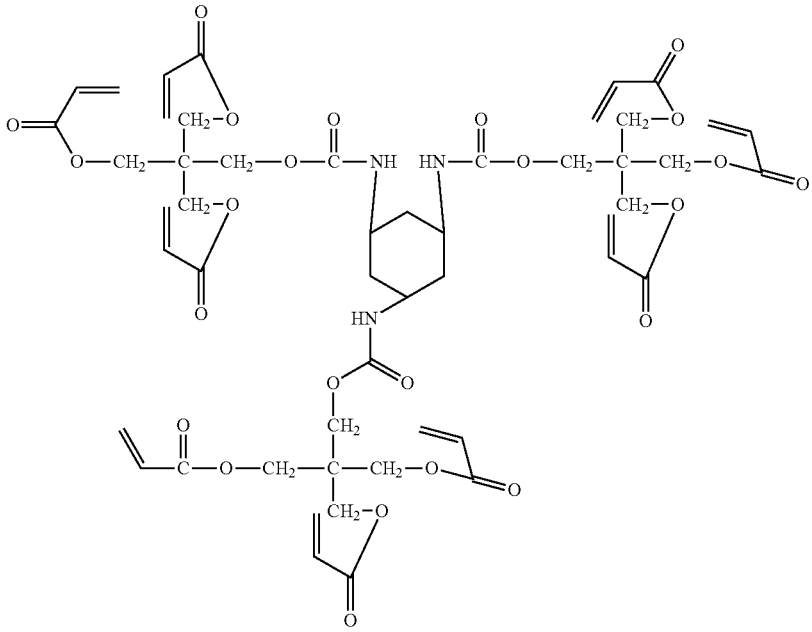

and A is 0.065 to 0.100, where A=S1/S2, and S1 and S2 each represent peak areas of a spectrum obtained by measuring a surface of the protective layer by total reflection Fourier transform infrared spectroscopy using Ge as an internal reflection element with a measurement condition of 45° as an incidence angle, when S1 is a peak area based on in-plane deformation vibration of terminal olefin, and S2 is a peak area based on stretching vibration of C=O.

7. An electrophotographic apparatus, comprising an electrophotographic photosensitive member, a charging unit, an exposure unit, a development unit and a transfer unit;

the electrophotographic photosensitive member comprising an electro-conductive support, a photosensitive layer and a protective layer in this order, the protective layer comprising a resin having a triarylamine structure and a cyclic structure represented by formulae (1) or (2)

(1)

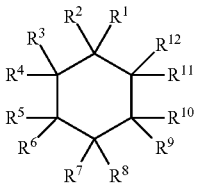

where at least two of $R^1$, $R^5$ and $R^9$ are represented by formula (3), and each of the substituents except the substituents represented by formula (3) in $R^1$ to $R^{12}$ is a hydrogen atom or a methyl group, (2)

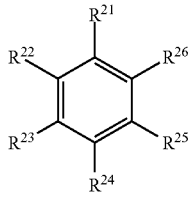

where at least two of $R^{21}$, $R^{23}$ and $R^{25}$ are represented by formula (3), and each of the substituents except the substituents represented by formula (3) in $R^{21}$ to $R^{26}$ is a hydrogen atom or a methyl group, (3)

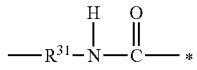

where $R^{31}$ is a single bond or an optionally substituted methylene group, $R^{31}$ bonds to a ring in the cyclic structure of formulae (1) or (2), and * represents having a bond, wherein the protective layer is formed as a cured film by polymerizing a composition containing a first monomer and a second monomer, wherein the first monomer is at least one selected from the group consisting of monomers of OCL-1 and OCL-2, and the second monomer is at least one selected from the group consisting of monomers of L-1, L-2, L-3, L-4, L-5, L-6, L-7 and L-8

(OCL-1)
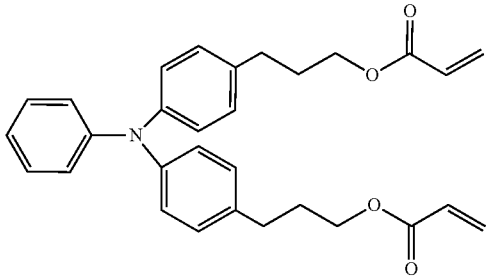
(OCL-2)
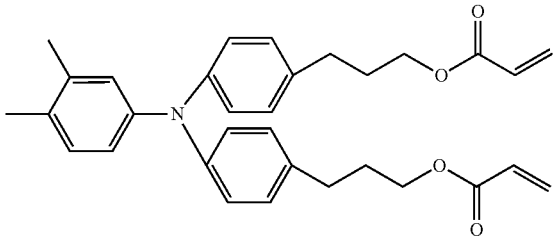
(L-1)
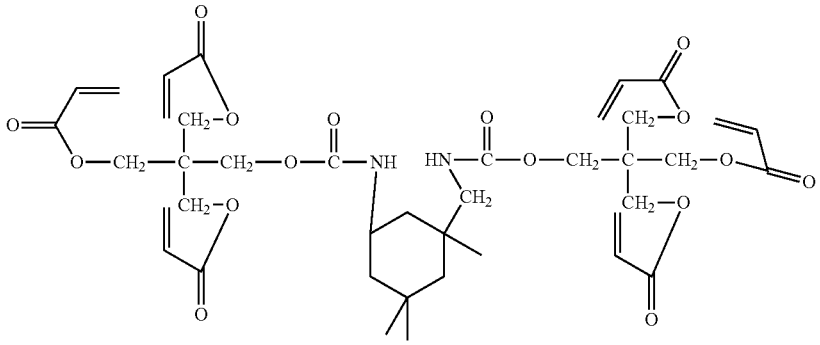
(L-2)
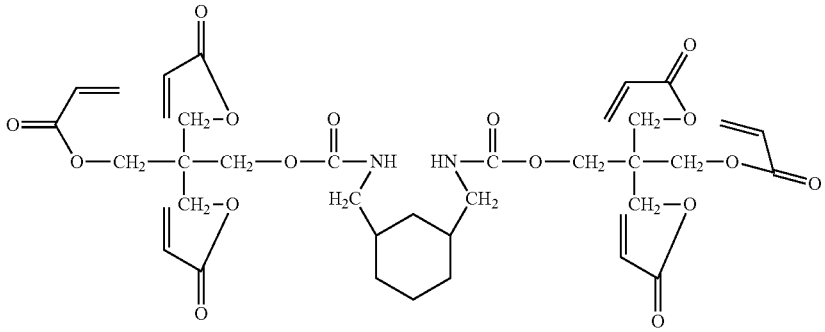
(L-3)
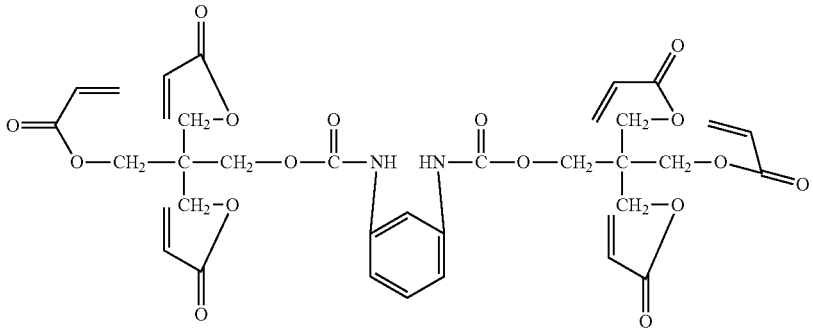

-continued
(L-4)
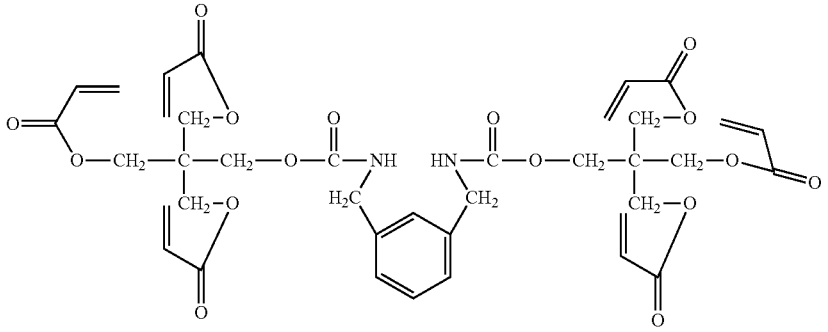
(L-5)
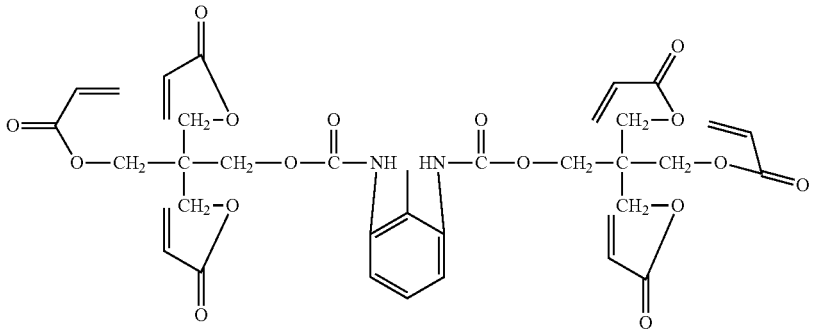
(L-6)
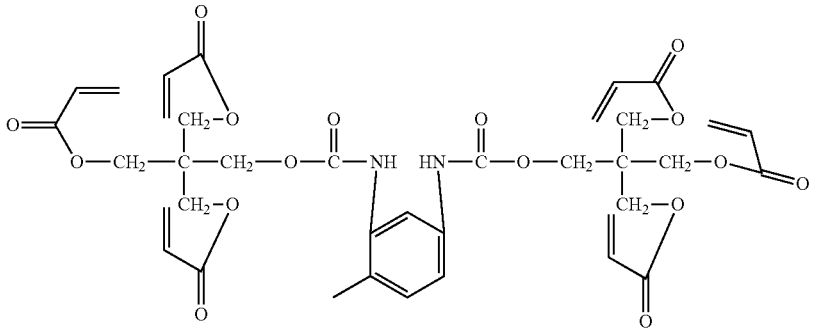
(L-7)
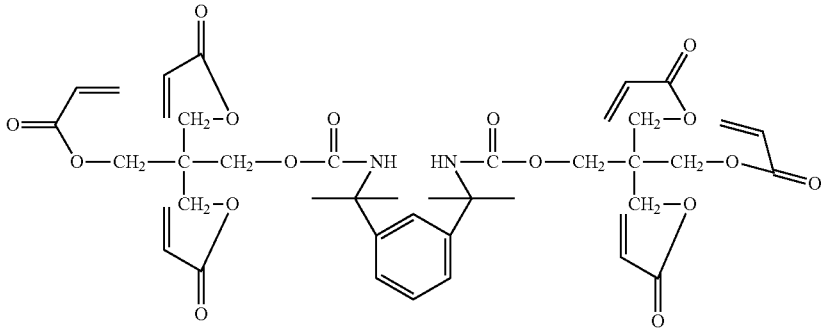

-continued (L-8)

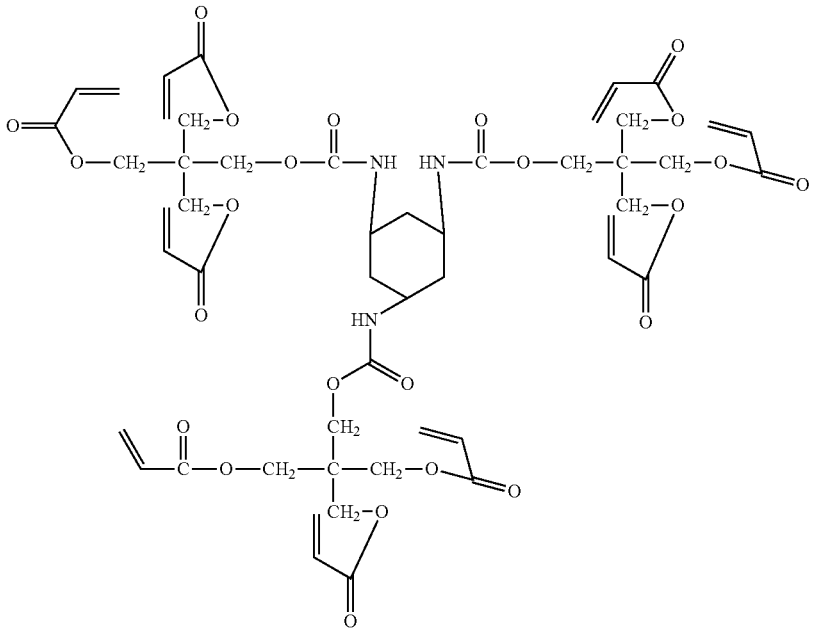

and A is 0.065 to 0.100, where A=S1/S2, and S1 and S2 each represent peak areas of a spectrum obtained by measuring a surface of the protective layer by total reflection Fourier transform infrared spectroscopy using Ge as an internal reflection element with a measurement condition of 45° as an incidence angle, when S1 is a peak area based on in-plane deformation vibration of terminal olefin, and S2 is a peak area based on stretching vibration of C═O.

* * * * *